US007503201B2

(12) United States Patent
Cleland et al.

(10) Patent No.: US 7,503,201 B2
(45) Date of Patent: Mar. 17, 2009

(54) TWO-STROKE TOOL

(75) Inventors: John G. Cleland, Cary, NC (US); Joseph R. Lemmens, Apex, NC (US)

(73) Assignee: MIL3, Inc., Cary, NC (US)

( * ) Notice: Subject to any disclaimer, the term of this patent is extended or adjusted under 35 U.S.C. 154(b) by 51 days.

(21) Appl. No.: 11/386,643

(22) Filed: Mar. 22, 2006

(65) Prior Publication Data

US 2006/0213248 A1 Sep. 28, 2006

Related U.S. Application Data

(60) Provisional application No. 60/665,495, filed on Mar. 25, 2005.

(51) Int. Cl.
*B25B 7/12* (2006.01)
*B21J 9/18* (2006.01)

(52) U.S. Cl. ..... 72/409.1; 72/409.07; 72/451

(58) Field of Classification Search ..... 72/409.12, 72/409.19, 409.01, 451, 409.1, 409.07–409.09; 81/383, 342, 367, 375, 377, 378, 313, 381
See application file for complete search history.

(56) References Cited

U.S. PATENT DOCUMENTS

| | | | | |
|---|---|---|---|---|
| 542,035 | A | 7/1895 | Willever | 81/363 |
| 1,910,838 | A | 5/1933 | Jenson | 72/409 |
| 2,503,783 | A | 4/1950 | Ward et al. | 81/367 |
| 2,532,659 | A | 12/1950 | Burns | 81/371 |
| 2,556,725 | A | 6/1951 | Hurlbut | 72/409 |
| 2,908,114 | A | 10/1959 | Fouse | 81/367 |
| 2,988,941 | A | 6/1961 | Ortman | 81/383 |
| 2,994,238 | A | 8/1961 | Matthysse | |
| 3,170,345 | A | 2/1965 | Poiongt | 72/409 |
| 3,277,751 | A | 10/1966 | Filia | |
| 3,393,438 | A | 7/1968 | Marley et al. | 72/410 |
| 3,481,373 | A | 12/1969 | Blagojevich | |
| 3,487,524 | A | 1/1970 | Filia | |
| 3,523,351 | A | 8/1970 | Filia | |
| 3,837,211 | A | 9/1974 | Gress et al. | 72/410 |
| 4,005,516 | A | 2/1977 | Bakermans | 29/749 |
| 4,040,179 | A | 8/1977 | Sanchez | 29/749 |

(Continued)

FOREIGN PATENT DOCUMENTS

| | | |
|---|---|---|
| GB | 1 522 144 | 8/1978 |

*Primary Examiner*—Dana Ross
*Assistant Examiner*—Teresa Bonk
(74) *Attorney, Agent, or Firm*—Myers Bigel Sibley & Sajovec

(57) ABSTRACT

A hand tool comprising first and second jaw members and first and second handle members, the first handle and both jaw members being cooperatively connected by a force multiplying linkage system. A force applied to the first handle drives the linkage system to close the jaws to crimp or cut a work piece. In one embodiment of the invention, a link in the linkage system has a first end movable between first and second positions relative to its first end pivot pin wherein the first and second jaw members close a first distance when the link first end is in the first position and close a second distance when the link first end is in the second position. Other embodiments comprise other step-wise changes in distance between force-bearing pivot locations in the linkage system to close the jaws progressive distances with successive closures of the first and second handles.

29 Claims, 19 Drawing Sheets

U.S. PATENT DOCUMENTS

| | | | | |
|---|---|---|---|---|
| 4,286,372 | A | 9/1981 | Batcheller | 29/516 |
| 4,611,511 | A | 9/1986 | Mykkanen | 81/9.44 |
| 4,735,442 | A | 4/1988 | Burli | 285/175 |
| 5,267,464 | A | 12/1993 | Cleland | 72/410 |
| 5,280,716 | A | 1/1994 | Ryan et al. | 72/409.07 |
| 5,307,565 | A | 5/1994 | Erbrick et al. | 30/251 |
| 5,309,751 | A | 5/1994 | Ryan | 72/450 |
| 5,596,800 | A | 1/1997 | Holliday et al. | 29/751 |
| 5,609,080 | A | 3/1997 | Flavigny | 81/368 |
| 5,680,788 | A | 10/1997 | Kootte | 72/452.8 |
| 5,722,284 | A | 3/1998 | Linsmeyer | 72/409.14 |
| 5,743,131 | A | 4/1998 | Holliday et al. | 72/409.1 |
| 5,845,393 | A | 12/1998 | DePaiva et al. | 29/751 |
| 5,870,925 | A | 2/1999 | Morris et al. | 72/409.12 |
| 5,913,933 | A | 6/1999 | Beetz et al. | 72/409.16 |
| 6,053,025 | A | 4/2000 | Beetz et al. | 72/409.16 |
| 6,138,346 | A | 10/2000 | Shutts et al. | 29/758 |
| 6,164,107 | A | 12/2000 | Korba et al. | 72/31.1 |
| 6,176,116 | B1 | 1/2001 | Wilhelm et al. | 72/409.12 |
| 6,269,675 | B1 | 8/2001 | Burnett | 72/454 |
| 6,279,432 | B1 | 8/2001 | Osborn et al. | 81/383 |
| 6,286,358 | B1 | 9/2001 | Beetz et al. | 72/409.12 |
| 6,293,004 | B1 | 9/2001 | Holliday | 29/751 |
| 6,672,128 | B2 | 1/2004 | Wagner et al. | 72/393 |
| 6,708,396 | B2 | 3/2004 | Holliday | 29/751 |
| 6,923,037 | B2 | 8/2005 | Bowles et al. | 72/416 |
| 6,941,628 | B1 | 9/2005 | Silverfox | 29/267 |

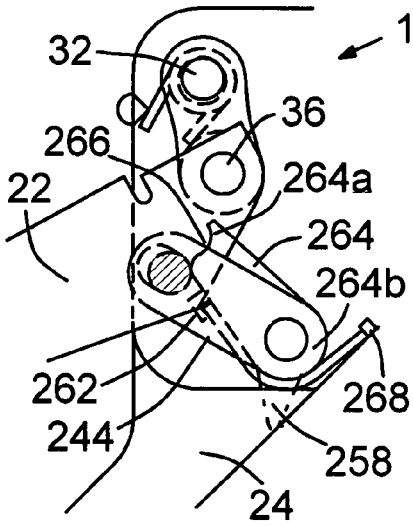
Fig. 4A
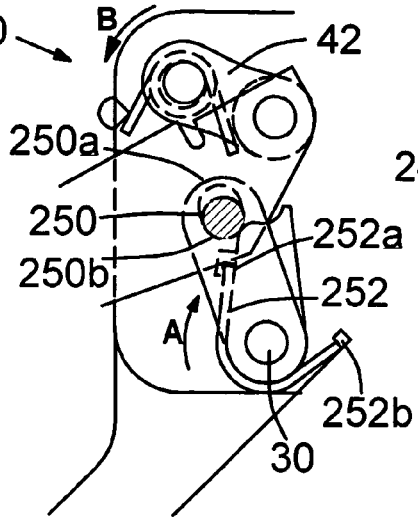
Fig. 4B
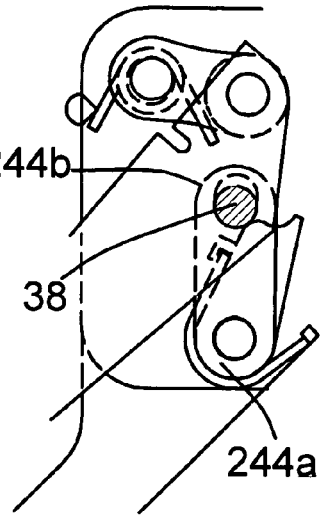
Fig. 4C
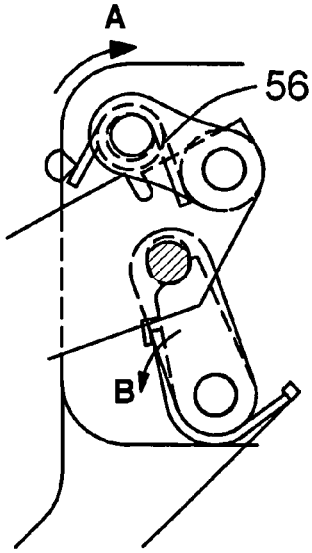
Fig. 4D
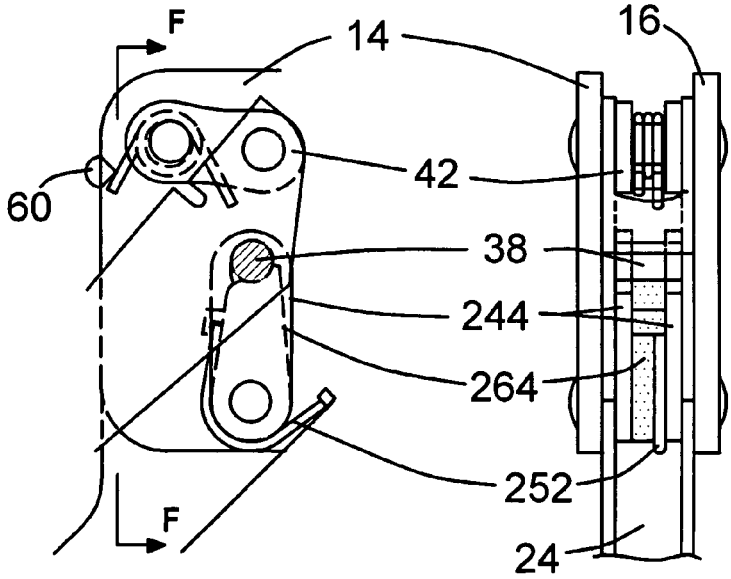
Fig. 4E
Fig. 4F

TWO-STROKE TOOL

RELATED APPLICATIONS

This application claims priority to U.S. Provisional Application Ser. No. 60/665,495 filed Mar. 25, 2005, the disclosure of which is hereby incorporated by reference in its entirety.

FIELD OF THE INVENTION

The present invention relates to hand tools. More specifically, the present invention relates to tools for crimp fitting of metal to plastic pipe and/or cutting tools.

BACKGROUND OF THE INVENTION

Tools for crimping a variety of materials for a number of applications include devices for pipe clamping or crimping such as in U.S. Pat. No. 4,286,372 to Batcheller and U.S. Pat. No. 4,735,442 to Burli.

Devices are known for the crimping and connecting of wire joints, such as in U.S. Pat. No. 3,523,351 to Filia; U.S. Pat. No. 3,481,373 to Blagojevich; U.S. Pat. No. 2,994,238 to Matthysse; U.S. Pat. No. 3,277,751 to Filia, U.S. Pat. No. 3,487,524 to Filia, and U.S. Pat. No. 6,279,432 to Osborn et al which discuss various mechanisms for translating a handle closing into a clamping force.

These devices may be bulky and difficult to use in a confined area or with a single hand operation. These tools may have extended handles utilized to achieve the necessary clamping or crimping force. Users of these devices may encounter difficulties due to the heavy, bulky, and often clumsy nature of these devices which may be inefficient, and difficult or impossible to use in specific applications, such as confined areas.

One particular operation for which it may be useful to have a convenient, lightweight and easy to use crimping tool is in the crimping of copper bands onto plastic pipe. In the crimping operation, the plastic pipe slides onto copper or brass fittings (in some applications plastic fittings are used), and is crimped in place using copper rings, which squeeze the pipe around each fitting connection. Often, pipe joints are located in constricted access locations. It may be difficult to align a long-handled tool on the crimp ring. A misaligned operation can result in a misalignment of the ring and/or movement of the ring from the proper position. Misalignment or improper location can result in a leaky fitting. Some devices reduce the handle length and handle movement required to open the crimping jaws of a tool and to crimp a fitting; however, these devices typically require both hands of a user to operate the tool. A two-handed tool may be difficult to use in constricted locations.

Some conventional crimping tools include bolt cutters having jaws modified for crimping instead of cutting. These devices generally have elongated handles which are opened up to a span of over two feet from tip to tip to allow the jaw to fit over a crimp ring. These devices typically require two-handed operation with hands far apart and elbows out, something that is difficult to do when working on ladders or in tight spaces. These tools also can require significant operator applied force in spite of the long handle mechanical advantage. These force and orientation requirements can cause difficulty in keeping a tool properly aligned on a crimp ring. Also the crimping jaws themselves must be opened to a wide span, which can prove difficult in constrained areas.

In addition, some compact, essentially one-handed crimping tools may require a relatively high hand force to perform crimping in a single hand stroke. Such tools provide advantages over the larger, two-handed tools described above but do not provide comfortable crimping ability for all operators. To improve mechanical advantage in a hand tool for which crimping jaws must compress a work piece of a specific size, while the movement of handles for closing the jaws is restricted to the distance of an open hand grip, the reduction of hand force may necessitate the compression to be completed in more than one hand stroke. It is desirable that such multiple hand strokes be conducted with a minimum of additional manipulation of the tool. It is also desirable that the jaws remain securely engaged with the work piece throughout the progression of such multiple hand strokes and compressions.

SUMMARY

According to embodiments of the present invention, a tool includes a first jaw member and a second jaw member pivotally connected to the first jaw member at a first pivot location. A first link is pivotally connected to the second jaw member at a second pivot location. A second link is pivotally connected to the first link at a third pivot location and pivotally connected to the first jaw member at a fourth pivot location. A handle is attached to the third pivot location, and a third link is movably connected at a first end thereof to the handle at a fifth pivot location and pivotally connected at an opposite second end thereof to the first jaw member at a sixth pivot location. The third link first end is movable between first and second positions relative to the fifth pivot location. The handle is configured to drive the first and second links through the third pivot location to rotate the second jaw member about the first pivot location in a first rotational direction and to rotate the first link in the first rotational direction and the second link in a second opposite rotational direction to at least partly close the first and second jaw members. The first and second jaw members are configured to close a first distance when the third link first end is in the first position and to close a second distance when the third link first end is in the second position.

According to further embodiments of the present invention, a tool includes a first jaw member and a second jaw member pivotally connected to the first jaw member at a first pivot location. A first link has a first end and a second end and the first end is movably connected to the second jaw member at a second pivot location. A second link is movably connected to the first link second end at a third pivot location and pivotally connected to the first jaw member at a fourth pivot location. The first link first end is movable between first and second positions relative to the second pivot location. A handle is attached to the third pivot location. A third link is pivotally connected to the handle at a fifth pivot location and pivotally connected to the first jaw member at a sixth pivot location. The handle is configured to drive the first and second links through the third pivot location to rotate the second jaw member about the first pivot location in a first rotational direction and to rotate the first link in the first rotational direction and the second link in a second opposite rotational direction to at least partly close the first and second jaw members. The first and second jaw members are configured to close a first distance when the first link first end is in the first position and to close a second distance when the first link first end is in the second position.

According to additional embodiments of the present invention, a tool includes a first jaw member and a second jaw member pivotally connected to the first jaw member at a first pivot location. A handle is pivotally connected to the second jaw member at a second pivot location and movably attached to a first end of a link at a third pivot location. The second end of the link is pivotally connected to the first jaw member at a fourth pivot location. The link first end is movable between first and second positions relative to the third pivot location. The handle is configured to rotate about the second pivot in a first rotational direction to drive the link through the third pivot location to rotate the second jaw member about the first pivot location in the first rotational direction and to rotate the link in a second rotational direction to at least partly close the first and second jaw members. The first and second jaw members are configured to close a first distance when the link first end is in the first position and to close a second distance when the link first end is in the second position.

BRIEF DESCRIPTION OF THE DRAWINGS

FIGS. 4A-4E are sequential, partial cut-away views of a crimping tool with one side plate removed illustrating operations thereof according to embodiments of the present invention;

FIG. 4F is a back end view of the crimping tool of FIGS. 4A-4E;

DETAILED DESCRIPTION OF THE INVENTION

Figure 1A:
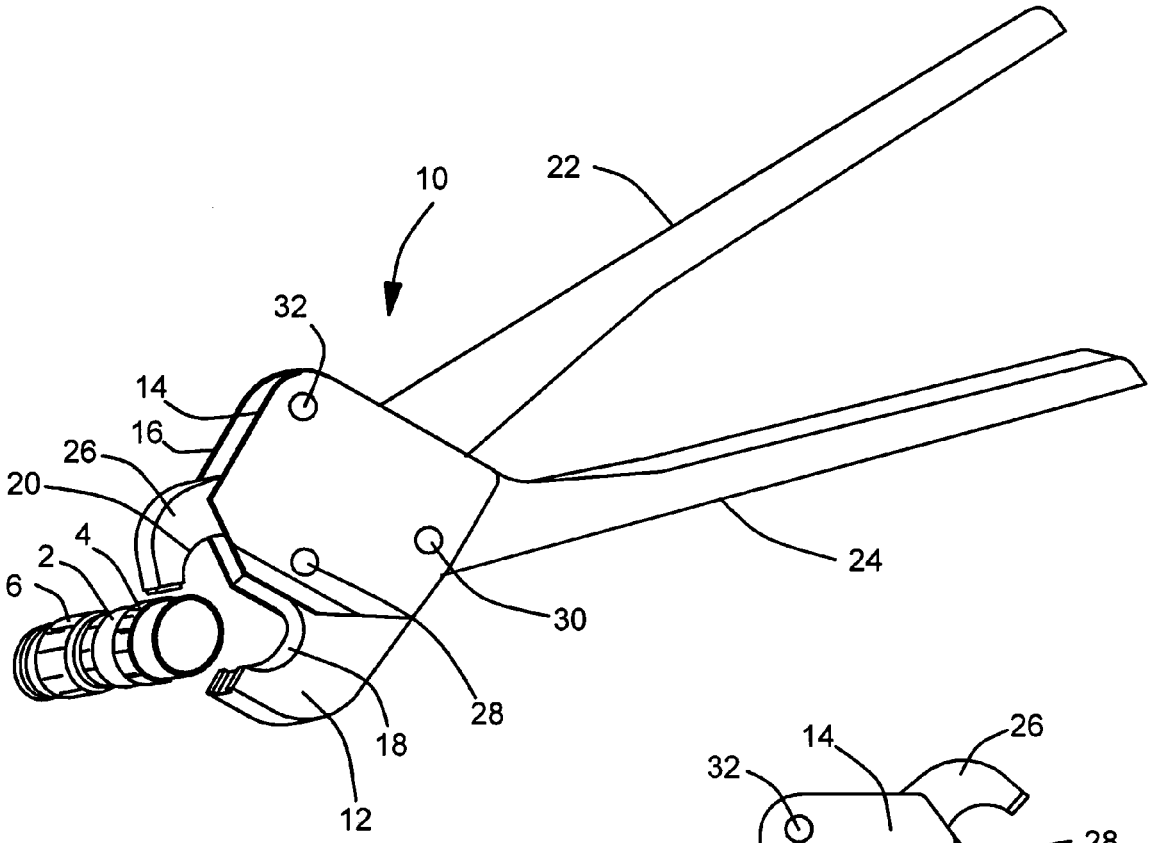
FIG. 1A is a perspective view of a crimping tool and pipe according to embodiments of the present invention.

The present invention now is described more fully hereinafter with reference to the accompanying drawings, in which embodiments of the invention are shown. All embodiments described in detail below have been successfully demonstrated with commercial hardware for crimping applications at full scale by the inventors, including detailed options within the description of embodiments. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Dotted lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

Spatially relative terms, such as "under", "below", "lower", "over", "upper", "front", "back", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise. In particular, for clarity, the terms 'front' and 'forward' generally refer to the end of a tool that is made up of the jaws for crimping while the terms 'back' or 'backward' refers to the opposite end from 'front' or 'forward' where a moving handle emerges for gripping by the operator's hand. The terms 'top,' 'upward' or 'upper' refer to the part of the tool represented toward the top side of a drawing, or generally the tool part including the moving jaw of the tool, as opposed to the 'bottom,' 'downward' or 'lower' part of the tool which holds the fixed jaw to the body of the tool. The terms 'bottom' or 'lower' also generally refer to that part of a tool where the fixed handle is held to the body of the tool.

The tool configurations of embodiments of the present invention may be used to provide two-stroke crimping and/or cutting in which each stroke may require significantly less force by an operator than an equivalent single-stroke crimp and/or cut. In particular embodiments, the tool includes jaw members that are pivotally connected to a handle by at least one link. One of the link ends is movable between two positions. The jaw members are configured to close a first distance when the link end is in one position and to close a second distance when the link end is in another position. The closure of the jaw members by the first distance when the link end is in one of the positions is referred to herein as the "first stroke" of the two-stroke crimping and/or cutting tool. The closure of the jaw members by the second distance when the link end is in the other position is referred to herein as the "second stroke" of the two-stroke crimping and/or cutting device. The first and second strokes may also be referred to as a first and second crimp or cut, respectively.

In this configuration, a cutting and/or crimping tool can be closed (or partly closed) by an operator using two strokes such that the force used for each stroke is less than the force that would be needed to move the jaw members through both the first and second distances in a single stroke. The two-stroke tool may make crimping and/or cutting less strenuous and fatiguing over crimping of several rings successively and/or successive cuts.

With respect to all figures described next the terms 'front' and 'forward' generally refer to the end of a tool that is made up of the jaws for crimping while the terms 'back' or 'backward' refers to the opposite end from 'front' or 'forward' where a moving handle emerges for gripping by the operator's hand. The terms 'top,' 'upward' or 'upper' refer to the part of the tool represented toward the top side of a drawing, or generally the tool part including the moving jaw of the tool, as opposed to the 'bottom,' 'downward' or 'lower' part of the tool, which holds the fixed jaw to the body of the tool. The terms 'bottom' or 'lower' also generally refer to that part of a tool where the fixed handle is held to the body of the tool.

Particular embodiments of the present invention will now be discussed with reference to the figures. FIG. 1A illustrates a pipe 2, a crimp ring 4, a crimp fitting 6, and a crimp ring tool 10 according to embodiments of the present invention.

Figure 1B:
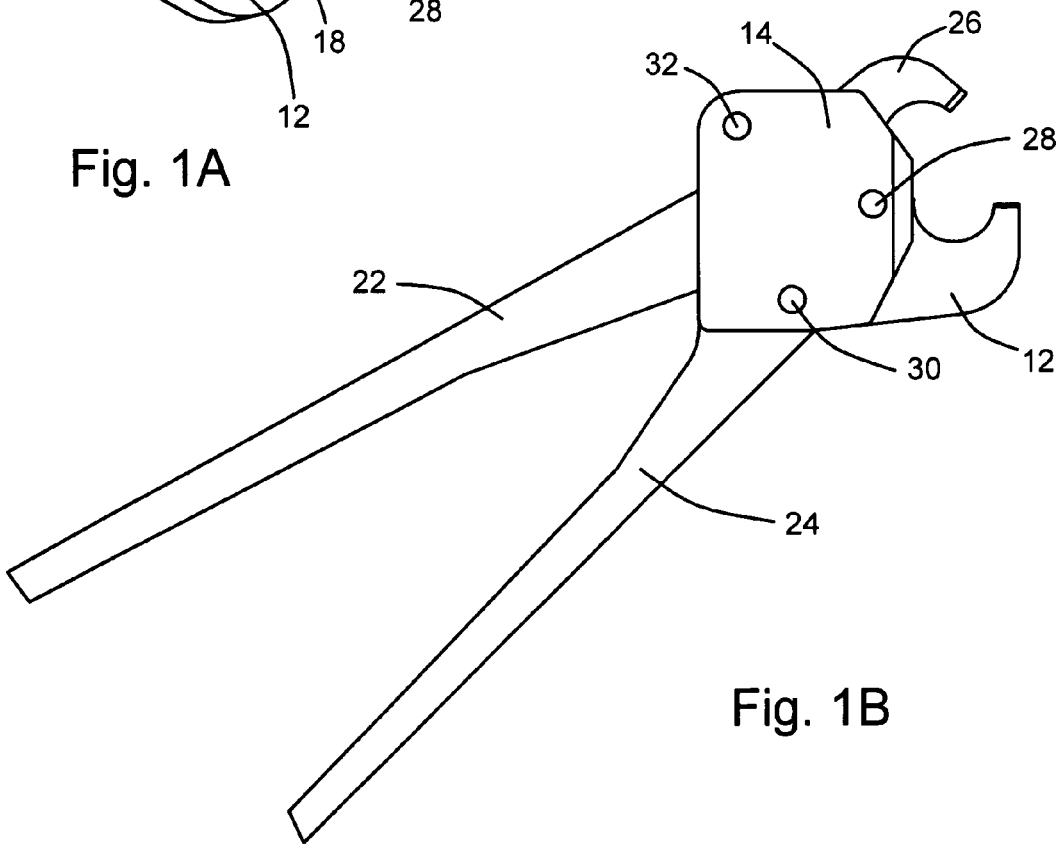
FIG. 1B is a reverse side view of the crimping tool of FIG. 1A.

With reference to FIGS. 1A and 1B, the tool 10 has two side plates 14 and 16, first and second jaws 12,26, handles 22,24, and pins 28,30, and 32. The first jaw 12 has a substantially semicircular portion (indicated by 18) and the second jaw 26 has a substantially semicircular portion (indicated by 20). The first jaw 12 is rigidly attached to the side plates 14, 16 or alternatively, formed integrally with the plates 14, 16. The semicircular portions 18, 20 have diameters selected to insure adequate compression of a desired size of crimp ring 4.

As shown in FIG. 1A, the crimp ring 4 fits over the pipe 2, and the crimping procedure includes sliding the pipe 2 and crimp ring 4 over a fitting 6 and then compressing the ring 4 with the crimp tool 10 to seal the pipe 2 to the fitting. The jaws 12 and 26 are positioned around the ring 4 and then closed to clamp the ring 4 in position about the pipe 2.

Referring to FIGS. 1A-B, the second jaw 26 is attached to the side plates 14 and 16 by the pivot pin 28. The second jaw 26 typically pivots through a maximum angle of less than about 50 degrees during a complete crimping cycle.

The side plates 14 and 16 have three apertures to accommodate the pins 28, 30 and 32 at locations configured for the application of a crimping force. The tool 10 is sized and configured so that a desired diameter may be achieved within the closed circle of the jaws 12, 26 to compress the ring 4 to the proper fit about the pipe 2. The handle 24 can be affixed to or otherwise held stationary relative to the first jaw 12 and the side plates 14 and 16.

Figure 2A:
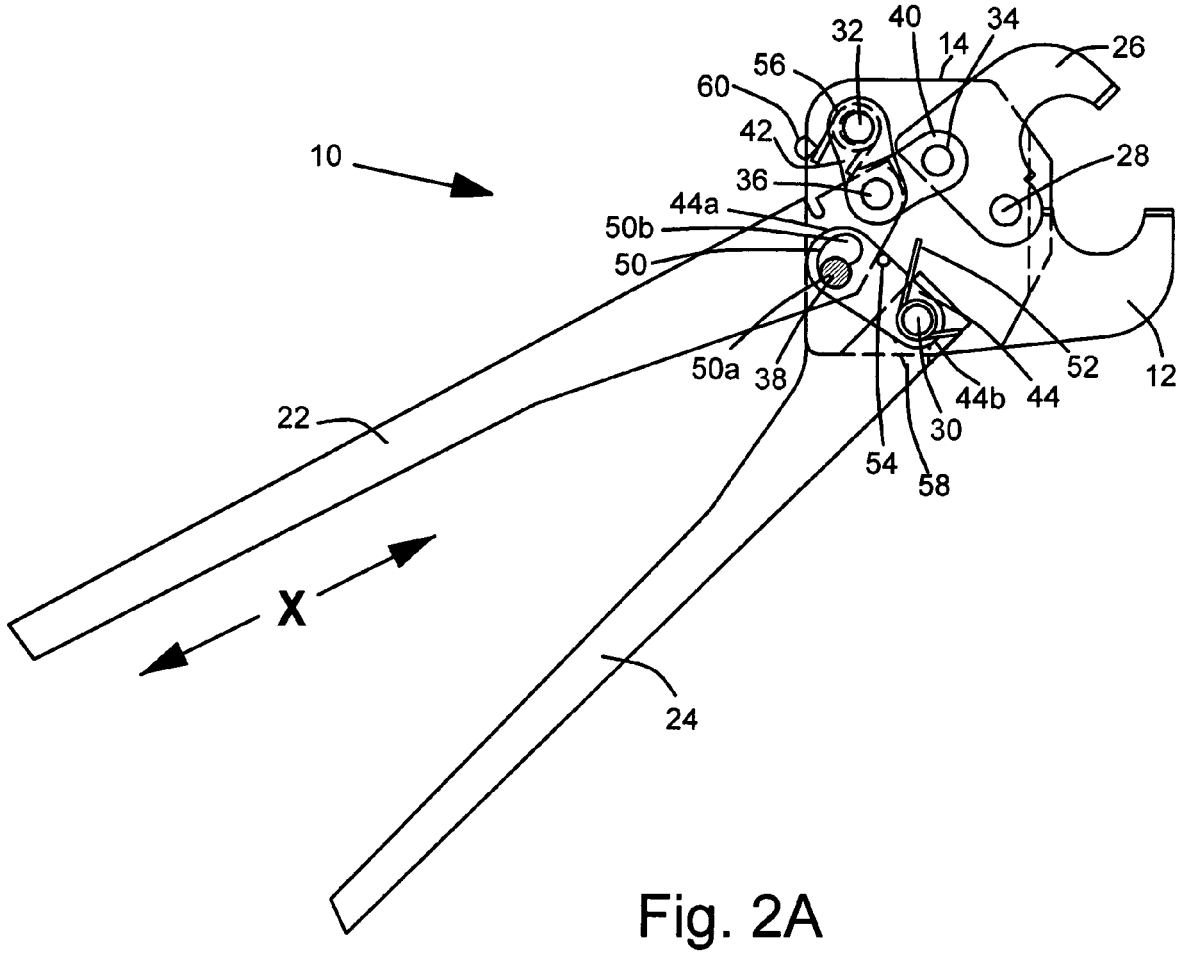
FIGS. 2A-2F are sequential cut-away views with one side plate removed illustrating operations of a linking system for the tool of FIGS. 1A-B according to embodiments of the present invention.

A first, preferred, embodiment of the present invention is illustrated in FIGS. 2A-H. Referring to FIG. 2A, the tool 10 is opened fully to receive a ring for crimping or release a crimped ring. The tool 10 contains an upper overcenter linkage assembly, including a first link 40, a second link 42, and the pins 32, 34 and 36. The tool 10 also contains a second, lower, overcenter linkage assembly, including a third link 44, the front end of handle 22, and the pins 30, 38, and 36. The term 'overcenter' herein refers to a linkage assembly where one or both links of the assembly can be leveraged into a position of alignment of the end pivot location of each link and the common pivot joining them, such alignment representing a position of minimal extension of the linkage being caused by further leverage, but maximum force multiplication of the leveraging force. Therefore, as a ring is crimped the last small distance (and resists the crimping most) the highest mechanical advantage times the hand force can be obtained. The two overcenter linkages increase mechanical advantage exponentially as they extend toward aligning the two participating links (overcenter position). The moving handle 22 is attached to the upper linkage assembly, while acting as a link in the lower linkage assembly, and this handle 22 moves relative to handle 24. Closing of the handles 22 and 24 imposes near alignment of both overcenter linkage assemblies, providing for closing of the jaws 12, 26 to complete crimping.

Both the opening and closing of the jaws 12 and 16 is accomplished by rotation and translation of the handle 22 relative to handle 24. The third link 44 extends between the handle 24 and the handle 22 to allow rotational and lateral movement of the handle 22 with respect to the first jaw 12 for opening and closing the second jaw 26. The 'fixed' handle 24 generally does not rotate about the axis of the pin 30. Link 44 rotates freely about the pin 30. The handle 22 is attached to the link 44 at the pin 38 and to the first and second links 40, 42 at the pin 36 and rotates about the pins 36 and 38.

The six pins 28, 30, 32, 34, 38 and 36 each allow free rotation of the links 40, 42 and 44, the handle 22 and the second jaw 26. As illustrated, the pins 28, 30 and 32 extend through the side plates 14 and 16 and are secured with snap rings, cotter pins, by swaging or through other suitable means as would be understood by one of ordinary skill in the art. The shorter, interior pins 34, 38 and 36 are restricted from axial movement by the interior walls of side plates 14 and 16.

In the first embodiment of this invention, FIGS. 2A-H, a torsion spring 52, or other biasing member, is fixed in place about the pin 30 and provides a backward bias to third link 44 when link 44 moves forward to engage spring 52. As illustrated, the spring 52 may push against a rod 54 which may be connected through the third link 44. Also, a biasing member, such as the torsion spring 56 held at the back by a fixed bar 60, may be incorporated to bias the link 42 to rotate upward, the pin 36 forward, and thus the jaws 26, 12 toward closure.

Also as illustrated in FIG. 2A, the pins 28, 30, 32, 34, 36 and 38 are positioned through the links 40,42 and 44 and an upper portion of the handle 22. The third link 44 includes an end 44*a* that is movably connected to the pin 38 and an end 44*b* that is pivotally connected about the pin 30. The end 44*a* includes a slotted opening 50 that, together with the pin 38, provides a movable connection at first and second positions 50*a*, 50*b*. A biasing member, such as a handle tab bias or the illustrated torsion spring 52 which is connected about the pin 30, moves the end 44*a* between the first and second positions 50*a*, 50*b*.

The links 40, 42, and 44 may each be formed of a single unitary member or of two halves or more link pieces positioned, for example, in parallel with design based on the formability and cost of the materials used to form the links 40, 42, and 44 at the desired thicknesses. The second jaw 26 is attached to the first link 40 at the front drive pin 34. Certain operations of the links 40, 42, and 44 are disclosed in U.S. Pat. No. 5,267,464 to Cleland, the contents of which is incorporated herein by reference in its entirety.

The pins 28, 29, 30, 32, 34, 36 and 38 define pivot locations for pivotally or movably connecting various components of the tool 10. In particular, the pin 28 pivotally connects the jaws 12, 26 and defines a first pivot location. The first link 40 is pivotally connected to the second jaw 26 by the pin 34, which defines a second pivot location. The second link 42 is pivotally connected to the first link 40 at the pin 36 (defining a third pivot location) and pivotally connected to the first jaw 12 at the pin 32 (defining a fourth pivot location). The handle 22 is attached at the pin 36 to the third pivot location. The third link 44 is movably connected at the end 44*a* thereof to the handle 22 at the pin 38 (defining a fifth pivot location) and pivotally connected at the opposite end 44*b* thereof to the first jaw 12 at pin 29 (defining a sixth pivot location). The opening 50 at the link end 44*a* provides the first position 50*a* and the second position 50*b* for the pin 38. Thus, the third link 44 is movable between first and second positions 50*a*, 50*b* relative to pin 38.

In this configuration, the handle 22 is configured to drive the first link 40 and the second link 42 through the third pivot location defined by pin 36 to rotate the second jaw 26 about the first pivot location defined by pin 28 in one rotational direction. The handle 22 rotates the first link 40 in the same rotational direction as the second jaw 26 and the second link 42 in the opposite rotational direction to at least partly close the jaws 12, 26. The jaws 12, 26 are configured to close a first distance when the pin 38 is in the first position 50*a* and a second distance when the pin 38 is in the second position 50*b* of the link end 44*b*. The torsion spring 52 is configured to urge the link end 44*a* so that the pin 38 held in the holes in handle 22 moves between the first position 50*a* and the second position 50*b*. These two positions in slot 50 provide the means for a two-stoke crimping tool in which the crimping is completed in two successive closures of the handles 22, 24 using much less hand force than if crimping with a single hand stroke. Although the tool 10 has been described as allowing two crimping strokes based on the two positions of the slot 50 in link end 44*a*, it should be understood that additional link positions may be used to provide three or more crimping strokes under some dimensional variations of 38 and 50.

Figure 2B:
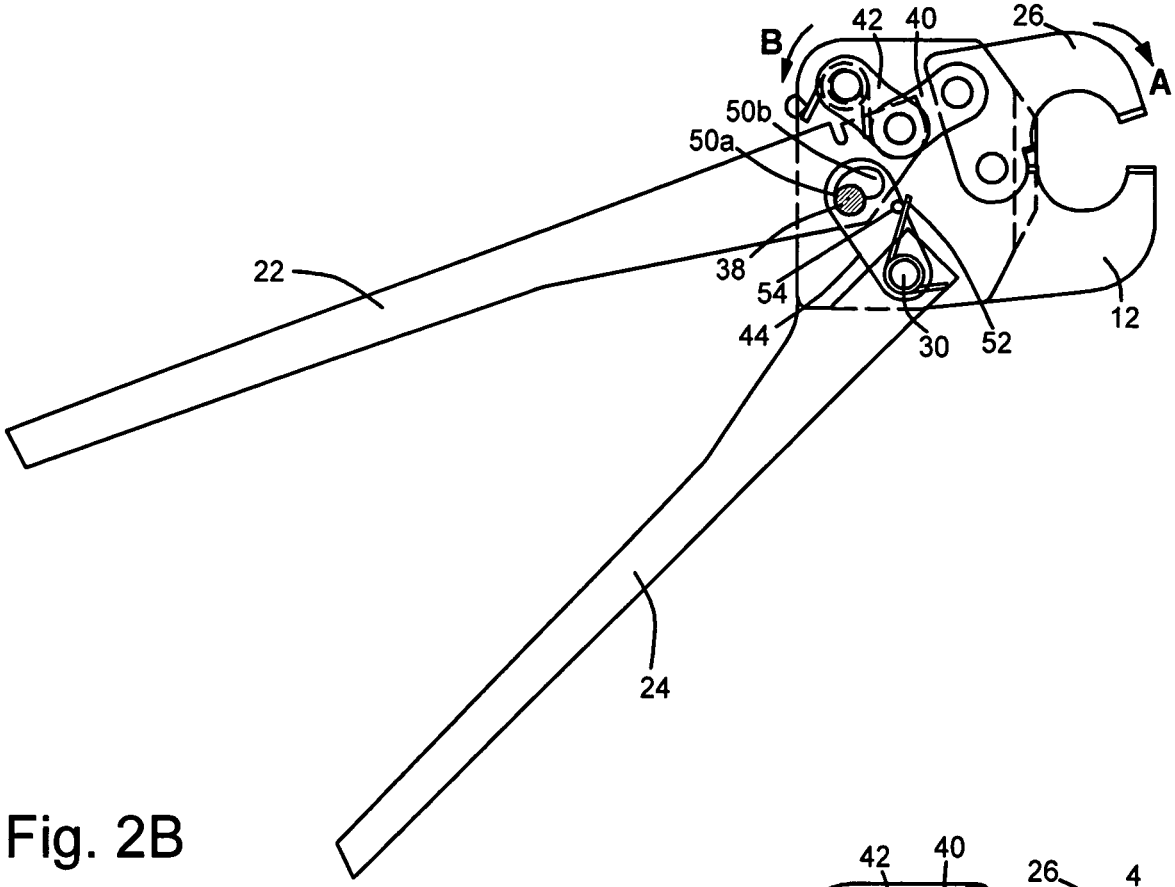
Figure 2C:
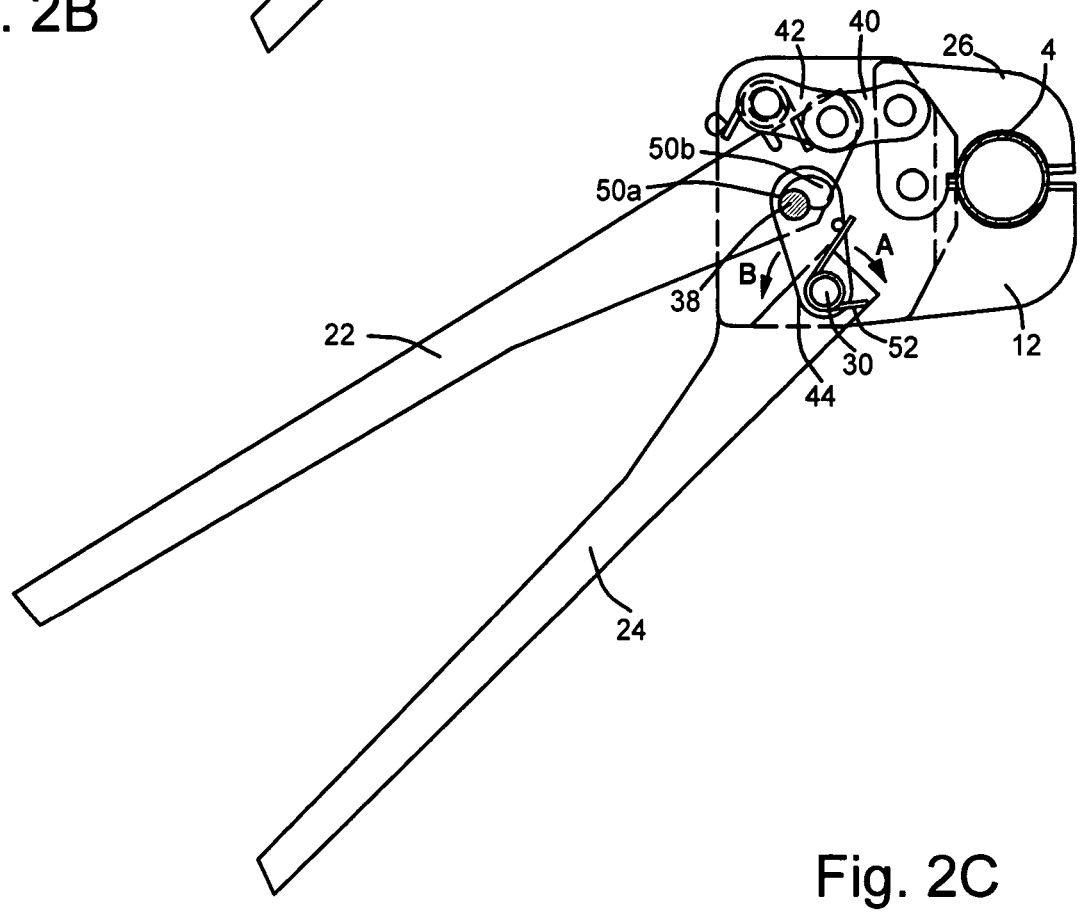
Figure 2D:
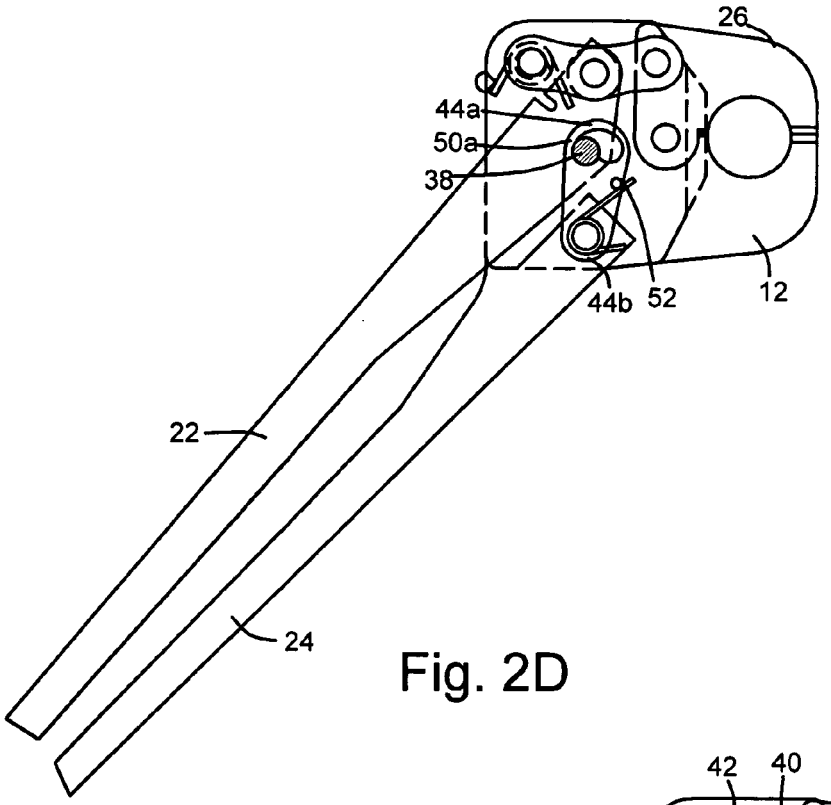

As shown in FIG. 2A, the jaws 12, 26 of crimping tool 10 are in a fully open position, and the link end 44*a* is in the first position 50*a*. This open position is that required, for example, for releasing a crimped ring or accepting a new ring for crimping. Because the handle 22 has been pulled fully back laterally in the direction X as shown in FIG. 2A, the pin 38 is urged to pull back into the first position 50*a* of link end 44*a*. When the handles 22, 24 and jaws 12, 26 are fully opened to accept a ring, the handles 22, 24 and jaws 12, 26 can be held in this receiving or releasing position by a single hand grip pressing the handles toward each other. A stop 58 on link 44 is included to impact the fixed handle 24 or the fixed jaw 12 in order to assure that link 44 cannot over-rotate when the handle 22 is opened and fully pulled back, ensuring that pin 38 remains in the first position 50*a*, thus setting the proper condition for beginning a first crimping stroke. Another abutment (such as the moving jaw 26 touching the rear top links 42) prevents the jaws 12, 26 and therefore the handles 22, 24 from moving further. In FIG. 2B, the handle 22 is moved slightly upwardly and toward the jaws 12, 26. When a user exerts pressure to bring the handles 22, 24 together, the first link 40 and the second jaw 26 move in a rotational direction A, and the second link 42 moves in an opposite rotational direction B to partly close the jaws 12, 26. In FIG. 2C, the handle 22 is closed downwardly and towards the jaws 12, 26, and the second link 42 moves in the rotational direction B. The third link 44 moves in the rotational direction A, and the torsion spring 52 passes through its relaxed or neutral position and begins to push bar 54 to urge the third link 44 in the opposite rotational direction B. The jaws 12 and 26 begin to exert pressure on the ring 4 to be crimped and pin 38 is held in position 50*a* by the resultant forces transmitted through the pins 30, 32, 34, links 40,42, 44, and handle 22 by the resistance to crimping by the ring 4. The first link 40 and the second jaw 26 move in the rotational direction A to further close the jaws 12, 26. As shown in FIG. 2D, the handle 22 is further moved towards the handle 24 to further close the jaws 12, 26. The motion described in FIGS. 2A-D illustrates completion of a first crimping stroke in which the handle pin 38 remains in the first position 50*a* and link end 44*a* ends in the position shown in FIG. 2D, allowing the jaws 12, 26 to close a first distance for crimping.

Figure 2E:
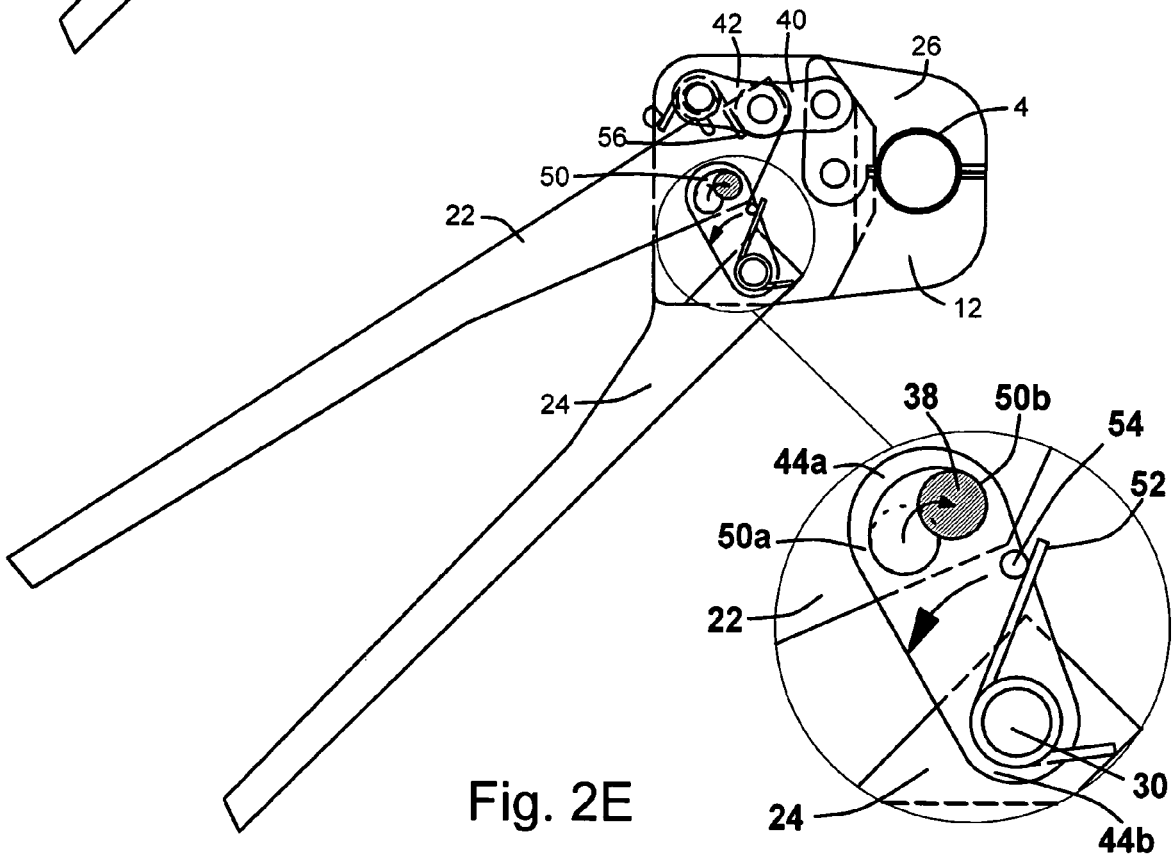
Figure 2F:
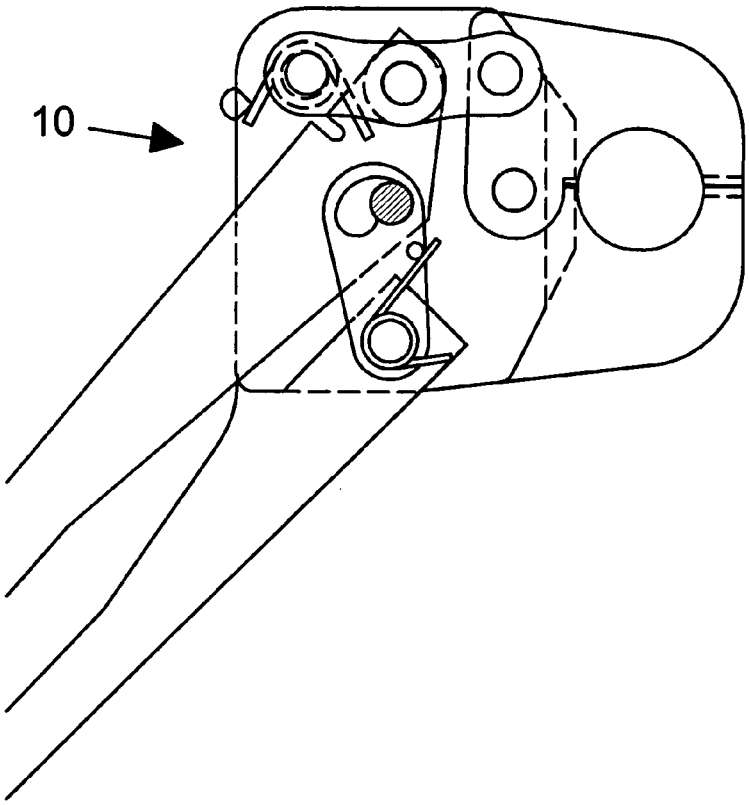

A second crimping stroke or motion completes the crimping of the ring 4 which is partially crimped to the degree shown in FIG. 2D. The second crimping cycle immediately follows that shown in FIGS. 2A-2D and during said second cycle the handle pin 38 is in the second position 50*b* of link end 44*b*, is shown in FIGS. 2E-F. In FIG. 2E, the potential energy from strain stored in the ring/pipe/fitting, links, pins, side plates, handles, and jaws during the first compression of the crimp ring 4 (FIG. 2D) is released and, assisted by the biasing member 52, causes the handles to spring quickly open to near the position shown. A "snap" or "click" sound from the link 44 jump to position 50*b* on pin 38 indicates completing of the first crimp and suitability for beginning handle closure to complete the second crimp.

The jaws 12, 26 stay almost closed on the ring and typically move apart less than 15% of a ring 4 wall thickness. This jaws position and the increased bias, for example by torsion spring 56 on links 40, 42, prevents pin 36 and links 40, 42 from dropping too low, so that pin 38 remains upward enough to allow its easy motion in slot 50. The torsion spring 52 urges the link end 44*a* back (for example, by pushing on bar 54) such that pin 38 jumps into the second position 50*b* from the first position 50*a* as the first handle 22 separates from the second handle 24. The relative geometries of springs 52, 56, links 40, 42, 44 and slot 50 are such that the opening of the handles 22, 24 is to a comfortable hand position for making the second crimp. The jaws 12, 26 maintain snug contact with the ring 4 throughout the second crimp sequence such that the second crimp will take place on the ring 4 in essentially the same position as the first crimp.

FIG. 2F illustrates the completion of the second crimp and the crimping cycle of the first embodiment. Jaws 12, 26 and handles 22, 24 are closed to the full extent required for designated crimping of the ring 4. The position of pin 38 and slot location 50*b* relative to pin 28 after the second crimping stroke is almost the same as position of pin 38 and slot location 50*a* relative to pin 28 after the first crimping stroke. Therefore, the degree of alignment of pins 30, 38, 36 may be the same at the end of both crimping strokes, allowing a maximum mechanical advantage to be exerted in both cases. This is because the pin 38 is held fixed relative to handle 22 and handle 22 is closed to the same position at the end of each crimping stroke (i.e., rear tip of handle 22 about touching the rear tip of handle 24).

Figure 2G:
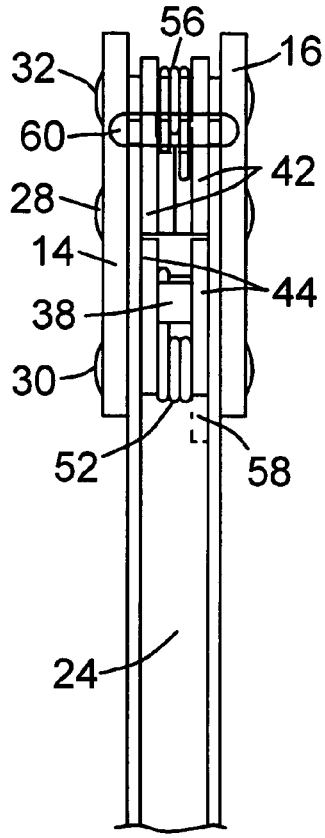
FIGS. 2G-2H are a back view and a top view, respectively, of the crimping tool of FIGS. 2A-2F.
Figure 2H:
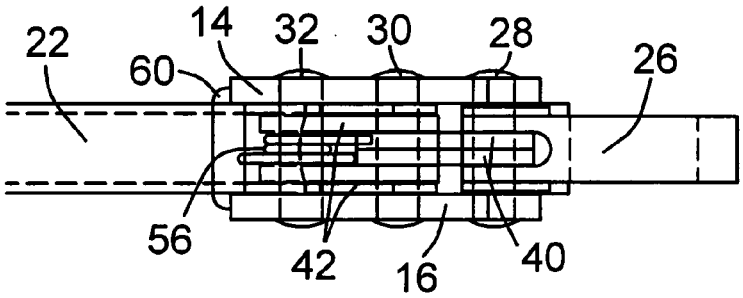

FIGS. 2G and 2H illustrate a top view and a back view respectively of the main body and internal parts of tool 10. The moving handle 22 is removed in FIG. 2G.

It will be understood from the above discussion and further discussion of related embodiments of the present invention, that the design of elements providing for a second crimping stroke are critical for operation. These critical design factors include the position of the slot locations 50*a*, 50*b* relative to pins 28, 30, 32, 34, and 36 and to one another; the relaxed position geometry of spring 52, and the relative angular spring tensions of springs 52 and 56.

A second embodiment of the present invention is shown in FIGS. 3A-E. The general crimping tool 10 is essentially the same as in the first embodiment described above (FIGS. 1A-B, FIGS. 2A-H) including fixed handle 24, first and second jaws 12, 26, side plates 14,16, first and second links 40,42, pins 28, 30, 32, 34, 36, 38, torsion spring 56, and bar 60. The moving handle 122 is modified to include a slotted opening 150 that, together with the pin 38, provides a movable connection at first and second positions 150*a*, 150*b*. The third link 144 with ends 144*a*, 144*b* is modified to replace the slot of the first embodiment with a simple circular hole to fit and hold pin 38. A biasing member, such as the torsion spring 152 located around pin 30 and held at one end 152*b* at a tab 162 on fixed handle 24 and on the other end 152*a* at bar 154, is included to urge link 144 to pivot about pin 30.

While the first and second jaws 12, 26 and the ends of handles 122, 24, are only partially shown or omitted, their geometry, relative positions and relative motions may be considered identical to those described for the first embodiment described above and illustrated in FIGS. 1A-B and FIGS. 2A-H. Essential features defining the second embodiment are illustrated in FIGS. 3A-E.

Figure 3A:
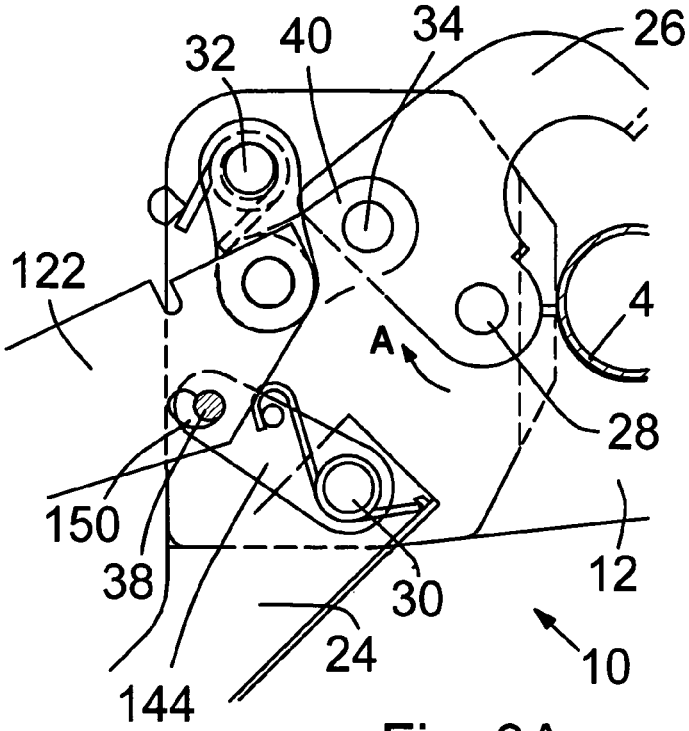
FIGS. 3A-3D are sequential, partial cut-away views of a crimping tool with one side plate removed illustrating operations thereof according to according to embodiments of the present invention.

In FIG. 3A, handle 122 is pulled full back to filly open the jaws 12, 26, like the condition in FIG. 2A. Link end 144*a* is rotated back about pin 30 and pin 38 is pulled into the 150*b* position of the slot 150 in handle 122. Spring end 152*a* is pulled back by bar 154 and also biases link 144 forward and into position 150*b*. The handles 122, 24 are next released slightly, the handle 122 moves laterally forward, and the handle 122 is then closed toward handle 24 to impel the closing of jaws 12, 26, similar to the progression described for FIGS. 2B-C.

Figure 3B:
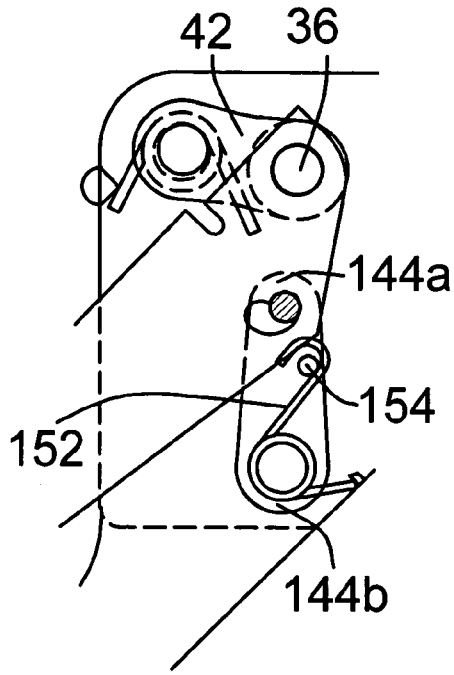

The first link 40 and the second jaw 26 move in a rotational direction A, and the second link 42 moves in an opposite rotational direction B, and the third link 44 moves in the rotational direction A. Spring 56 biases link 42 in rotational direction B, thus pulling handle 122 forward. Spring 152 biases link 144 in rotational direction A until torsion spring end 152*a* passes through its relaxed position (e.g., a position having essentially no or very little torque). At almost the same position, the resistance force of the ring 4 being crimped against the jaw 26 translates into a force by handle slot position 150*b* against pin 38 so the pin remains in position 150*b* until the first crimp is completed even though torsion spring 152 biases link 144 in rotational direction B during the last part of the first crimp. The completion of the first crimp is shown in FIG. 3B. A "snap" or "click" sound indicates completing of the first crimp and suitability for beginning handle closure to complete the second crimp.

The pin 38 pushes up the handle at slot position 150*b* such that the length from the bottom of pin 30 to the top of pin 36 is slightly less than length over the same span at the end of the second crimp (FIG. 3D) when pin 38 is in slot position 150*a*. Therefore, the first crimp closes the jaws 12, 26 slightly less than the second crimp.

Figure 3C:
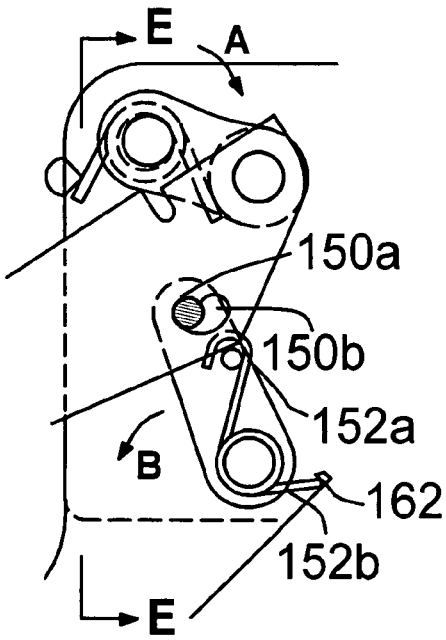
Figure 3D:
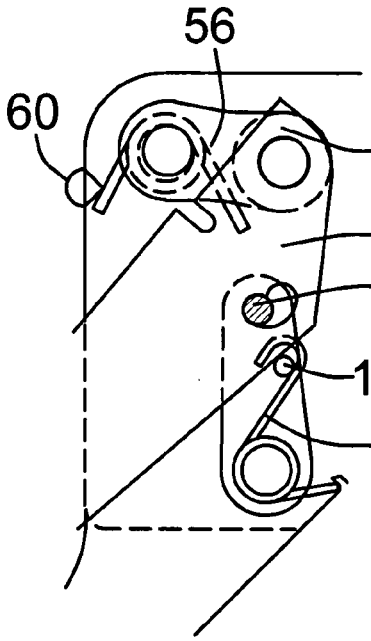

FIG. 3C illustrates the springing open of handle 122 immediately following the first crimp stroke. The pressure on pin 38 at slot position 150*b* is released and the torsion spring 152 urges link 144 in rotational direction B, moving pin 38 into slot position 50*a*. The handle 122 is then closed, completing the second crimp as shown in FIG. 3D.

Figure 3E:
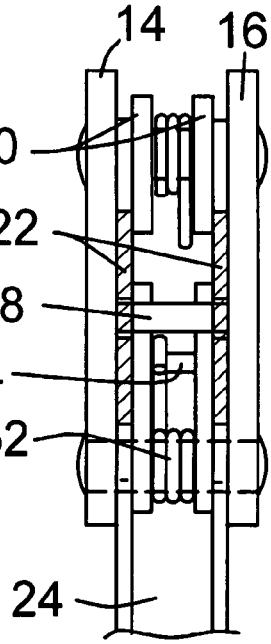
FIG. 3E is a back end view of the crimping tool of FIGS. 3A-3D.

FIG. 3E shows a back view of the tool of the second embodiment corresponding to the side view of FIG. 3C cut along line E-E. The pin 38 and slot positions 150*a*, 150*b* may be as small diameters as allowable for accepting the force loads of the crimping process. Since the pin 38 is movable in the slot 150 in handle 122, when the handle 122 is closed to the same position at the end of each crimping stroke (i.e., rear tip of handle 22 about touching the rear tip of handle 24), pin 38 will necessarily be a different distance from pin 28 (similar to FIG. 2D) at the end of the second crimp stroke versus the end of the first crimp stroke. The difference in distance is approximately the offset of the centers of slot positions 150*a* and 150*b*. To improve the degree of alignment of pins 30, 38, 36 and the maximum mechanical advantage at the end of both crimping strokes, the offset of the centers of slot position 150*a* and 150*b* should be minimized while still allowing reliable functionality.

A third embodiment of the present invention is shown in FIGS. 4A-F. The general crimping tool 10 is essentially the same as in the first embodiment described above (FIGS. 1A-B, FIGS. 2A-H) including first and second handles 22, 24, first and second jaws 12, 26, side plates 14,16, first and second links 40, 42, pins 28, 30, 32, 34, 36, 38, torsion spring 56, and bar 60. The third link 244 with ends 244*a*, 244*b* is modified to include a slot opening 250 which is aligned along the axis of link 244 through the centers of pins 30, 38. Slot 250, together with the pin 38, provides a movable connection between handle 22 and link 244 extending through the first and second slot positions 250*a*, 250*b*. Handle 22 retains simple circular holes to fit and hold pins 36, 38. A cam member 264 is added which also rotates about pin 30 as does link 244. Cam member 264 may be located between the two halves of link 244 as illustrated in FIG. 4F. The cam member 264 has a first end 264*b* which pivots about pin 30 and a second end 264*a* which has an arc 266 in the top surface to fit pin 38 and allow easy movement of pin 38 into the back side of the top surface but prevent movement of pin 38 out the front side of the surface. A biasing member, such as the flexure spring 252 located around the cam member 264 and held at one end 252*b* at a tab 262 on fixed handle 24 and on the other end 252*a* at tab 268 on cam member 264, is included to urge the cam member 264 to pivot about pin 30.

Although portions of the first and second handles 122, 24, the first and second jaws 12, 26, link 40, and the pins 28, 34 are omitted in FIGS. 4A-F, their geometry, relative positions and relative motions may be considered identical to those described for the first embodiment described above and illustrated in FIGS. 1A-B, FIGS. 2A-H. The essential features defining the second embodiment are all shown in detail in FIGS. 4A-F.

In FIG. 4A, the handle 22 is pulled full back to filly open the jaws 12, 26, like the condition in FIG. 2A. The link 244 is rotated back about pin 30 and pin 38 is pulled off the curved top surface 266 of cam member 264. A biasing member, such as the flexure spring 252, urges the cam member 264 in a rotational direction A (see FIG. 4B). A stop 258 on cam member 264 may be included to assure that pin 38 moves off of the end of cam member 264 when the handle 22 is pulled fully back.

The handles 22, 24 are next released slightly, the handle 22 moves laterally forward, and the handle 22 is then closed toward handle 24 to impel the closing of jaws 12, 26, as shown in FIG. 4B, and similar to the progression described in FIGS. 2B-C. Both links 244 and 264 rotate in direction A about pin 30, but link 264 continues to move ahead of link 244 because of the rotation of handle 22 in the rotational direction B about pin 36. Pin 38 is held below the top surface of link end 264*a*. The second link 42 moves in a rotational direction B, and the third link 244 moves in the rotational direction A. Spring 56 biases link 42 in rotational direction B, and assists in pulling handle 22 forward. Flexure spring 252 biases link 264 in rotational direction A until flexure spring end 252*a* passes through its relaxed position (no torque). Although flexure spring 252 next begins to urge link 264 in the opposite rotational direction B, the closure of handle 22 continues to push pin 38 into the slot end 250*b* of slot 250 until the first crimp is completed. The completion of the first crimp is shown in FIG. 4B. Release with a "snap" or "click" sound from the jump to position 264*a* on pin 38 indicates completing of the first crimp and suitability for beginning handle closure to complete the second crimping stroke.

When the pin 38 is in slot position 250*b*, the length from the bottom of pin 30 to the top of pin 36 is slightly less than the same length over the same span at the end of the second crimping stroke (FIG. 4E) when pin 38 is in slot position 250*a* and sitting on top of the cam member 264. Therefore, the first crimping stroke closes the jaws 12, 26 slightly less than for the second crimping stroke.

FIG. 4D illustrates the springing open of handle 22 immediately following the first crimp stroke. The pressure pushing pin 38 into slot position 50*b* is released and the Flexure spring 252 urges link 244 in rotational direction B, moving pin 38 onto curved surface 266 at end 264*a* of link 264. The handle 22 is then closed from the comfortable hand position at the end of the first crimp, completing the second crimp as shown in FIG. 4E.

FIG. 4F shows a back view of the tool of the third embodiment corresponding to the side view of FIG. 4E cut along line F-F.

The position of pin 38 in slot location 250*a* at the end of the second crimping stroke is almost the same as position of pin 38 and slot location 50*b* at the end of the first second crimping stroke. Therefore, the degree of alignment of pins 30, 38, 36 may be the same at the end of both crimping strokes, allowing a maximum mechanical advantage to be exerted in both cases. This is because the pin 38 is held fixed relative to handle 22 and handle 22 is closed to the same position at the end of each crimping stroke (i.e., rear tip of handle 22 about touching the rear tip of handle 24).

A fourth embodiment of the present invention is illustrated in FIGS. 5A-D. The general crimping tool 10 is essentially the same as in the first embodiment described above (FIGS. 1A-B, FIGS. 2A-H) including the first and second handles 22, 24, the first and second jaws 12, 26, the side plates 14, 16, the first and second links 40, 42, and the pins 28, 32, 34, 36, 38. For any parts of tool 10 omitted in FIGS. 5A-D, their geometry, relative positions and relative motions may be considered identical to those described for the first embodiment described above and illustrated in FIGS. 1A-B and FIGS. 2A-H. The third link 344 has a slotted hole 350 while the circular holes in the moving handle 22 snugly fit the diameter of pin 38 for pivoting of handle 22 about pin 38. A fourth link 364 which rotates about pin 38 is added such that fourth link 364 engages and disengages from pin 330 as shown in FIGS. 5A-D, with engagement around the slot 366 in link 364. A torsion spring 352 engages the link 364 at a holding tab 362 on link 364 and actively biases the link 364 to rotate about pin 38 and toward pin 330.

Figure 5A:
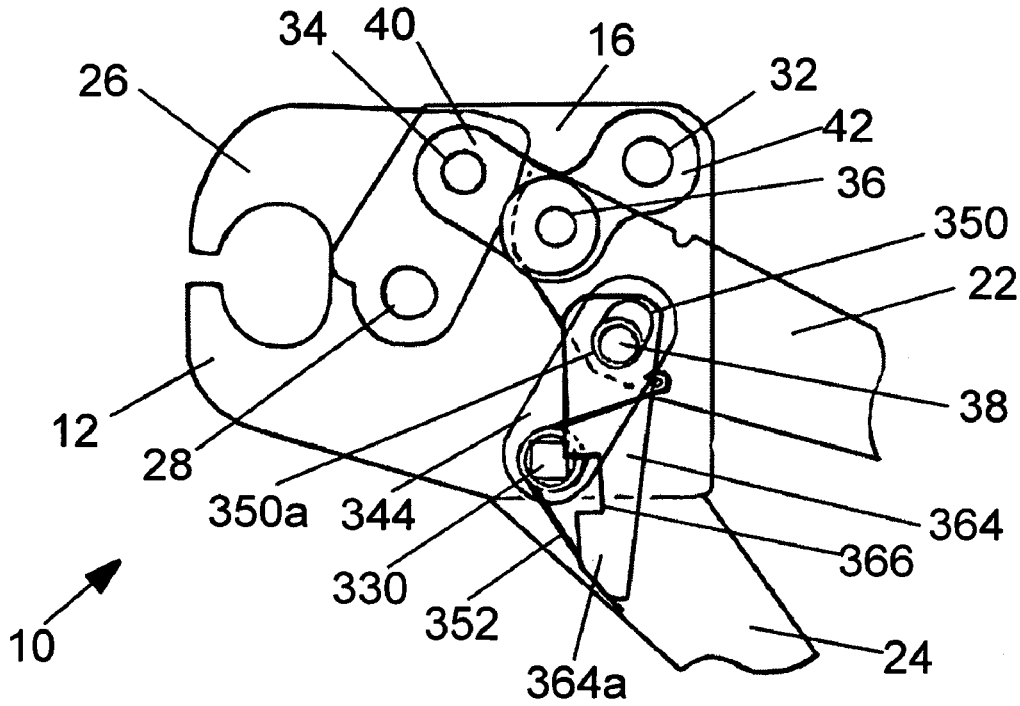
FIGS. 5A-5D are sequential, partial cut-away views of a crimping tool with one side plate removed illustrating operations thereof according to embodiments of the present invention.
Figure 5B:
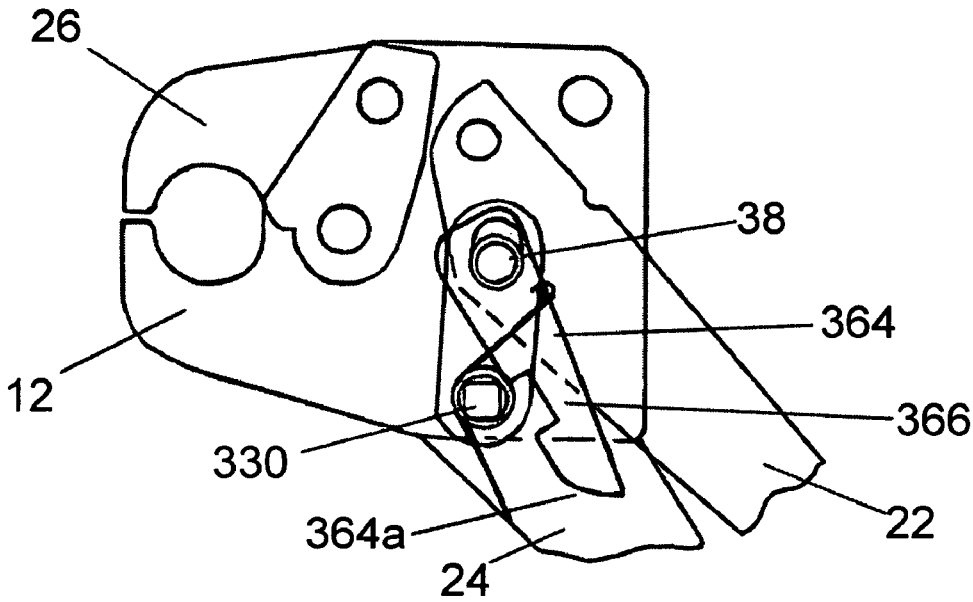
Figure 5C:
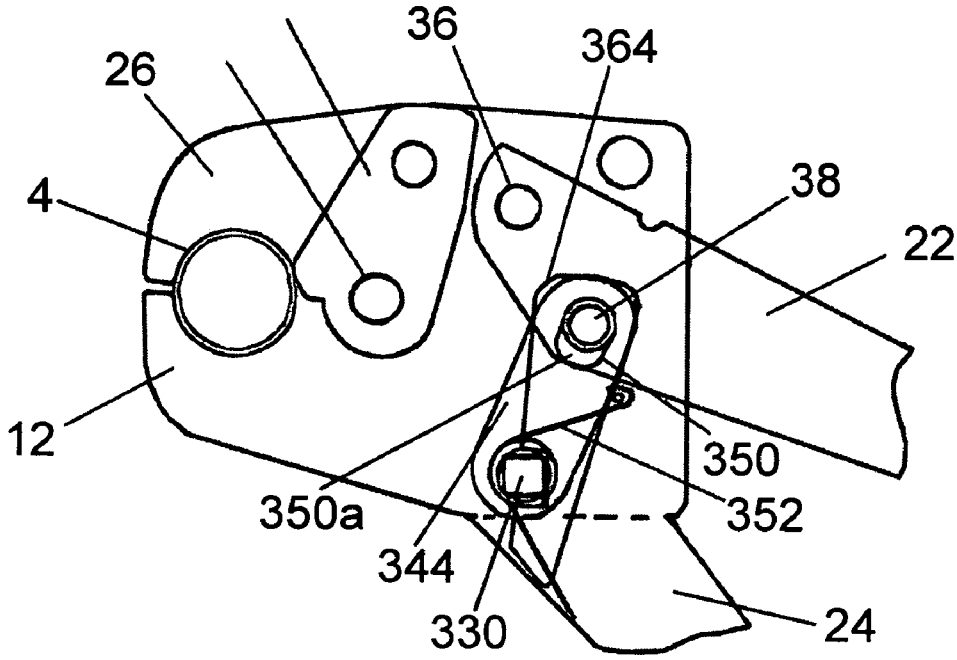

The beginning of the first crimping stroke is shown in FIG. 5A, with link 364 disengaged from pin 330 and with the bottom surface 364*a* of link 364 just touching the inside surface of fixed handle 24. The pin 38 is held in the bottom end 350*a* of slot 350 by the resistance of ring 4 being crimped, thus imparting a downward motion to pin 36. At the end of the first crimp shown in FIG. 5B, the link 364 is just held away from slipping onto pin 330 because of the lower position of pin 38. The bottom 364*a* of link 364 is clear (here exaggerated) of the inside of the handle 24. When the handles 22, 24 are released after the first crimp, the handles spring slightly apart, as shown in FIG. 5C, the ring 4 resistance force is released, pin 38 can move up in slotted hole 350 as handle 22 moves up, and torsion spring 352 biases link 364 to engage pin 330. The second and final crimp stroke is then performed as shown in FIG. 5D.

This fourth embodiment also incorporates the effective lengthening of the distance between the bottom of pin 330 and the top of pin 36 from the first crimp to the second crimp This is accomplished by the position of pin 38 in the bottom end 350*a* of slot 350 in link 344 being lower at the end of the first crimp than the position of pin 38 when pushed by its hole in link 364 when link 364 is engaged on pin 330 at the end of the second crimp.

Figure 5D:
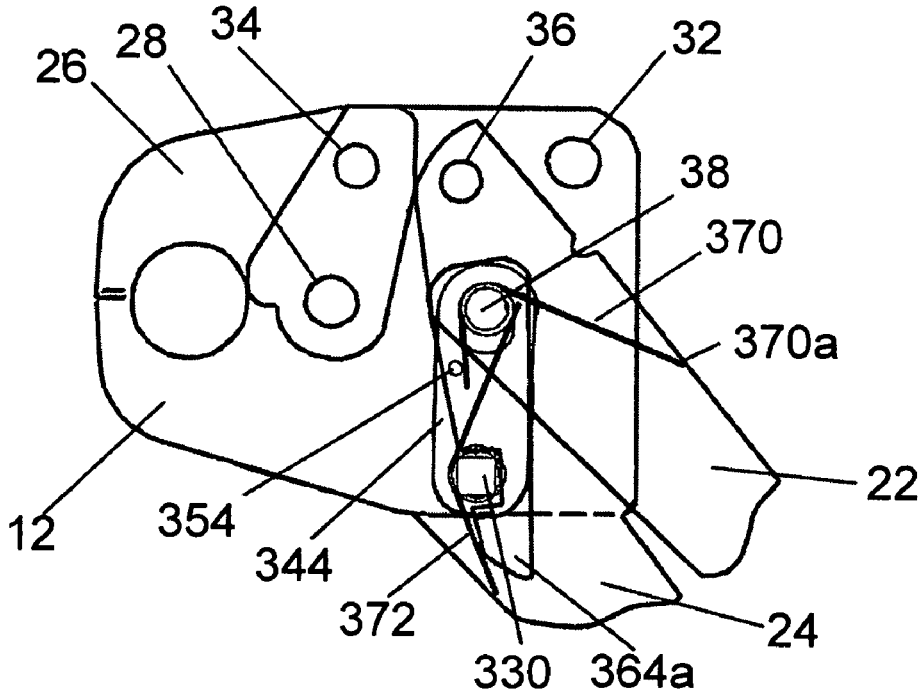

FIG. 5D also shows how the biasing spring 352 may be replaced by spring 370 about pin 38 with, for example, one end 370*a* impinging on the inside of handle 22 and the other end pushing against bar 354. Spring 372 is also shown to be included for biasing pin 38 to effect closing of first jaw 26 to second jaw 12 when no force is being exerted on the handles 22, 24.

After completion of the second crimping stroke, the handles 22, 24 are fully opened and handle 22 pulled back, disengaging link 364 from pin 330, assisted by the bottom 364*a* of link 364 impinging on the inside surface of the fixed handle 24. The crimping cycle is then repeated.

As demonstrated in the first four embodiments, a two stroke crimping tool may be implemented by providing two positions for the lower link 44, 144, 244, 344 of the tool 10, using the moderate-force, lower-overcenter-linkage assembly to provide the means for crimping force reduction by using two or more crimping strokes. The higher-force, upper-overcenter-linkage assembly can also provide a link having two positions for two crimping strokes and lower hand force, as described below.

A fifth embodiment of the present invention is illustrated in FIGS. 6A-G. The general crimping tool 10 is essentially the same as in the first embodiment described above (FIGS. 1A-B, FIGS. 2A-H) including first and second handles 22, 24, first jaw 12, side plate 14, second link 42, and pins 28, 30, 32, 36, 38. For any parts of tool 10 omitted in FIGS. 5A-D, their geometry, relative positions and relative motions may be considered identical to those described for the first embodiment described above and illustrated in FIGS. 1A-B and FIGS. 2A-H. The first jaw 426 and first link 440 are connected at pin assembly 434, and the inner wall of side plate 416 includes a precisely located inclined surface 476, that interacts with pin assembly 434 to influence an axial motion of the pin assembly 434. A torsion spring 452 actively pushes on the pin 38 and keeps the tool jaws 12, 426 closed when no hand force is applied to the handles.

Figure 6A:
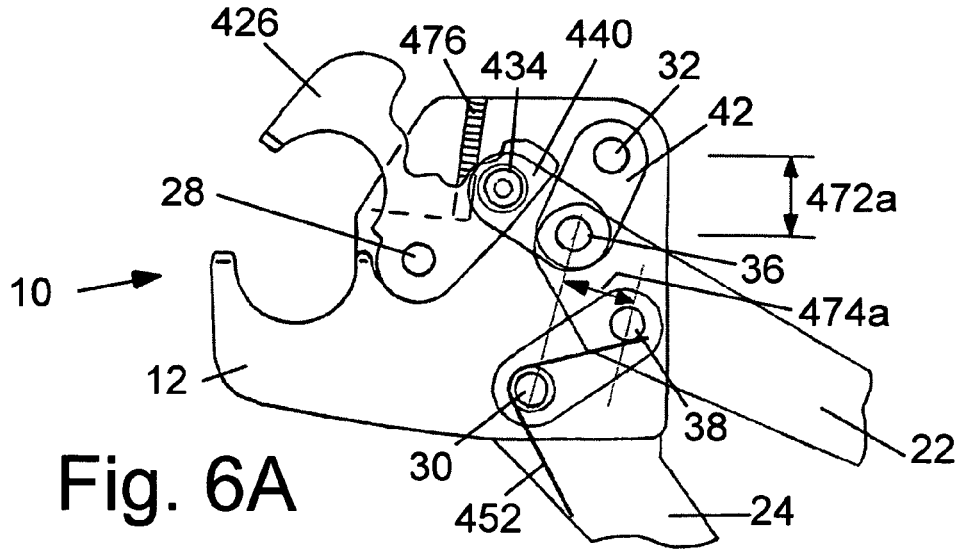
FIGS. 6A-6C are sequential, partial cut-away views of a crimping tool with one side plate removed illustrating operations thereof according to embodiments of the present invention.

FIGS. 6A, B, and C show, respectively, the progression from a fully opened tool 10 to a partially closed tool 10 where jaws 12, 426 are just touching the ring 4 to be crimped, to a fully closed tool 10 at completion of a first crimp. FIG. 6D is a top view of the end of the first crimping stroke for the tool of FIG. 6C, FIG. 6F is the top view detail just subsequent to the full closure of FIGS. 6C, 6D when the handles 22, 24 have sprung open, and FIG. 6G is a top view of the fully closed tool at completion of the second crimp, also closely approximated by FIG. 6C.

Figure 6B:
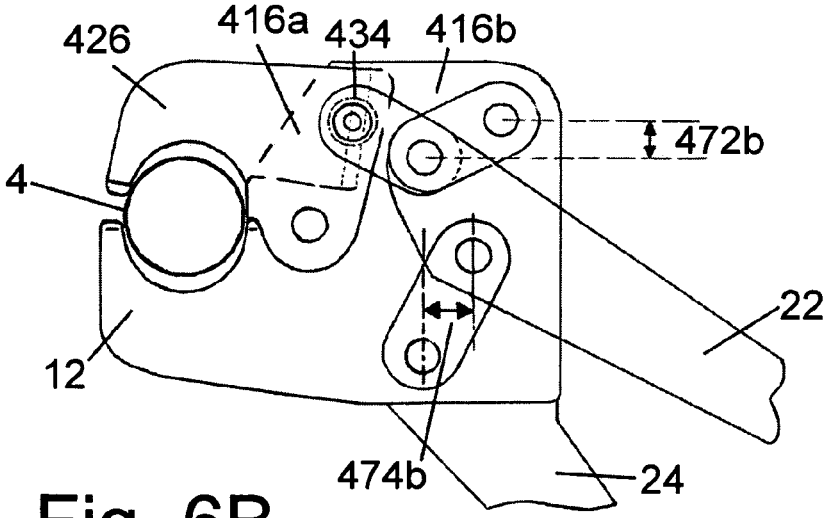
Figure 6C:
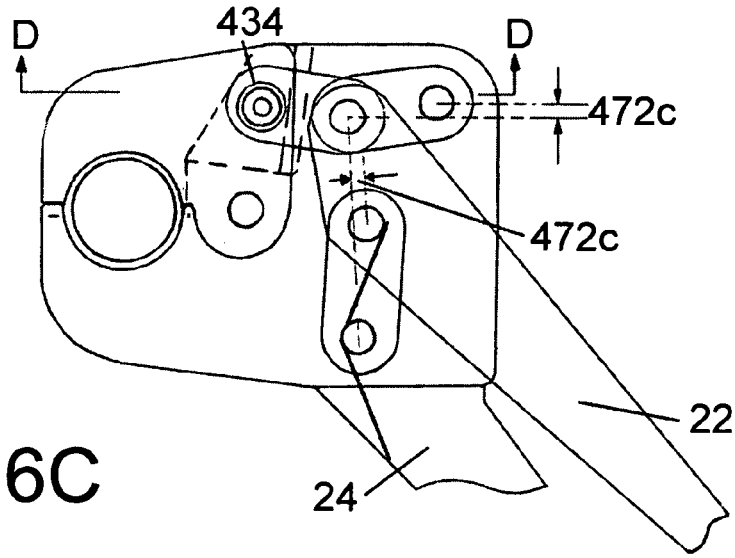
Figure 6D:
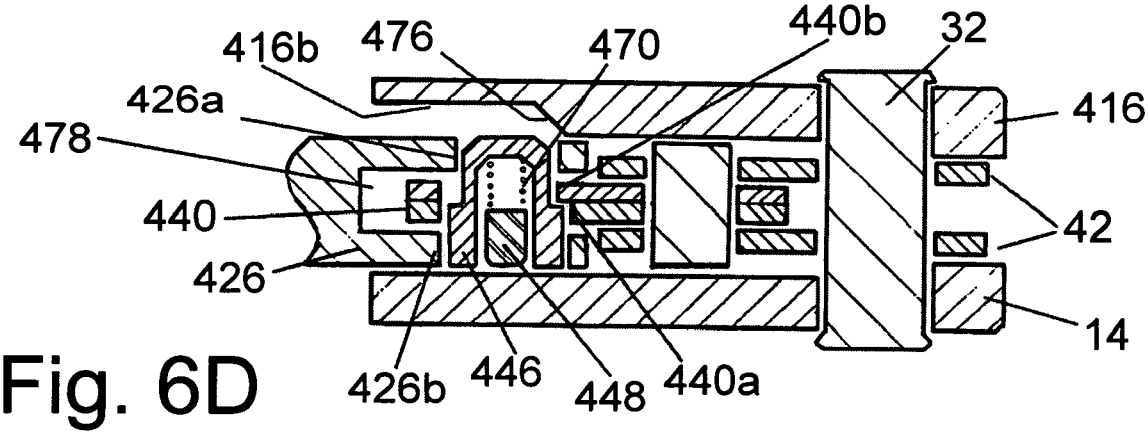
FIGS. 6E-6G are sequential, partial top views of the crimping tool of the fifth embodiment shown in FIGS. 6A-6C.
Figure 6E:
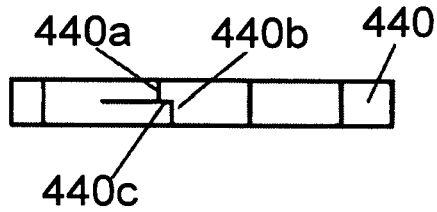
Figure 6F:
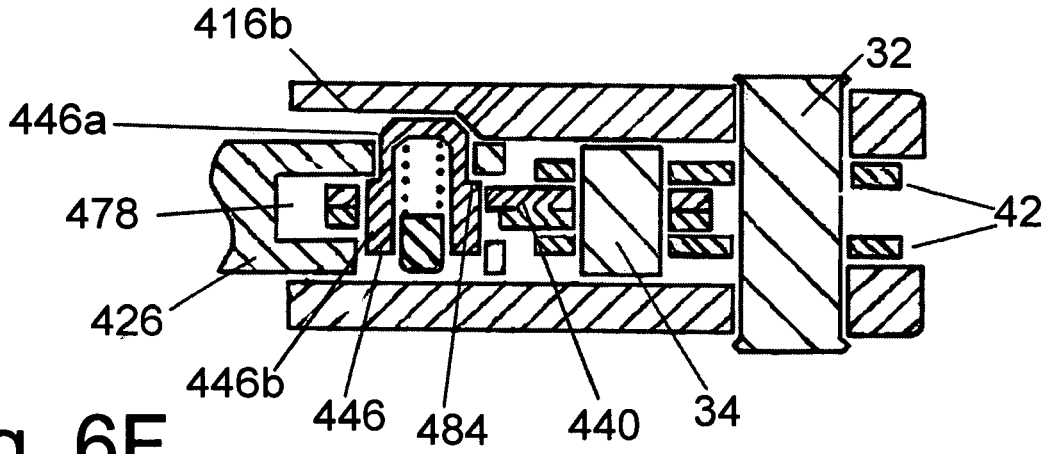
Figure 6G:
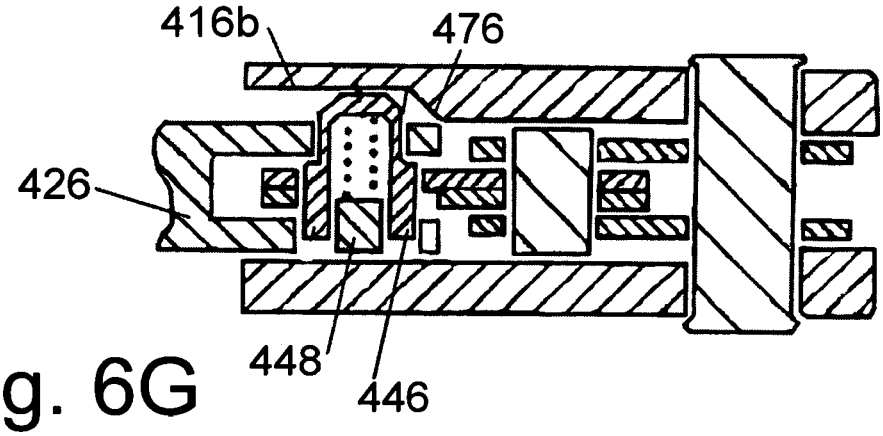

As seen in FIGS. 6D, 6F, 6G, the translating pin assembly 434 includes a double-diameter, hollow pin 446 with an inside pin 448 and compression spring 470. The pin 446 moves axially in the concentric holes 426*a* and 426*b* in the moving jaw 426. The pin 446 also moves axially in the holes 440*a* and 440*b* in the top front link 440 (two contiguous links or solid link as in FIG. 6E). The step offset 440*c* in the link holes 440*a* and 440*b* represents the difference in the motion of pin 446 and jaw 426 from the end of the first crimp to the end of the second crimp. Pin 446's translation is affected by 1) the push of the compression spring 470 against pin 446's inside end wall and against inside pin 448 which pushes pin 446 toward the side wall 416's thin wall interior 416*b* when pin 446 pushes jaw 426 closed for the second crimp, and 2) the push against pin 446 by the internal inclined surface 476 when the jaw 426 is fully opened after the end of the second crimping stroke.

Also, as seen in FIG. 6F, the pin 446 has a smaller diameter section 446*a* and a large diameter section 446*b* including a pin abutment surface 484 which contacts the offset 440*c* of link 440.

The open tool of FIG. 6A shows a relatively long offset 472*a* away from overcenter alignment of the links 42 and 440 and also a similarly long offset 474*a* away from overcenter for the lower linkage assembly 22, 344. The pin 446 is along the thicker portion 416*a* of side wall 416.

The start of crimping shown in FIG. 6B illustrates the decreasing overcenter offsets 472*b* and 474*b*. As illustrated in FIG. 6B, the crimp tool is shown as the movable jaw 426 is starting to crimp ring 4 but with the movable handle 426 still near a maximum open position. The axially translating pin 446 is still located within the thick-walled section 416*a* of wall 416 and of inclined surface section 476. The round hole 440*b* of link 440 pushes against the smaller diameter 446*a* of pin 446 and the elongated hole 440*b* of link 440 pushes against the larger diameter 446*b* of pin 446. This position continues through the end of the first crimp shown in FIG. 6C. The handles 22, 24 are fully closed and minimal overcenter offsets 472*c*, 474*c* occur.

FIG. 6D is a view of tool 10 represented by the cross section indicated by line D-D in FIG. 6C. This cross section shows the upper overcenter linkage assembly 32, 42, 34, 440. Front link 440 is held inside the cavity 478 of jaw 426 by pin 446. Pin 446 pushes on movable jaw 426 through small hole 426*a* and large hole 426*b* in jaw 426, as numbered in FIG. 6F.

FIG. 6F refers to a position, when the movable handle 22 has sprung open from released potential energy stored during the first crimp, FIG. 6D. This handle re-opening allows rear links 42 to pull back on center pin 34 which pulls back on front link 440 and allows the axially translating pin 446 to snap axially into the link section 440*b* of the front link 440, and against the thin wall 416*b*, and readies the tool for a second crimping stroke. A "snap" or "click" sound from the axial jump of pin 446 indicates completing of the first crimping stroke and suitability for beginning handle closure to complete the second crimping stroke.

FIG. 6G illustrates the end of the second crimping stroke with the movable jaw 426 is pushed slightly more closed than for the first crimp condition seen in FIG. 6C. Pin 446 has moved away from the inclined surface 476 and is now along the thin wall 416*b*. When the handles 22, 24 open after the second crimp and handle 22 is pulled back, the radial forces on pin 426 are diminished and the pin 446 rides up on the inclined surface section 476 to be reset to the condition seen in FIG. 6A.

Figure 7A:
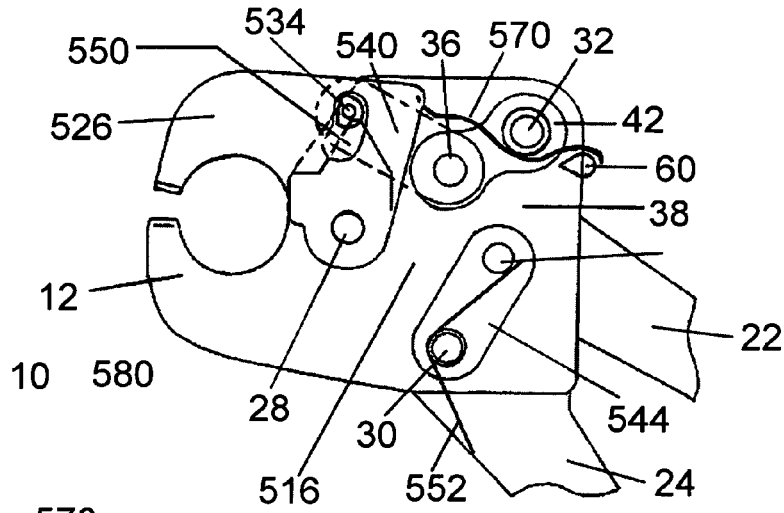
FIGS. 7A-7D are sequential, partial cut-away views of a crimping tool with one side plate removed and a detail view of a crimping tool illustrating operations thereof according to embodiments of the present invention.

A sixth embodiment of the present invention is shown in the sequential view of FIG. 7A as a two-stroke crimping tool, but based on resetting of the position of the pin 534 that drives the moving jaw 526 of the crimping tool 10. The general crimping tool 10 is essentially the same as in the first embodiment described above (FIGS. 1A-B, FIGS. 2A-H) including first and second handles 22, 24, first jaw 12, second link 42, pins 28, 30, 32, 36, 38, and a bar 60. A torsion spring 552 actively pushes on the pin 38 and keeps the tool jaws 12, 526 closed when no hand force is applied to the handles.

The pin 534 may have a flat surface 534*a*, and is movably secured to the front jaw 526 and to a front link 540. The pin 534 is also secured inside a cavity in the movable jaw 526 by the position of pin 534 through the circular holes in link 540, which snugly fit pin 534, and through the slotted holes 550 in the jaw 526 cavity walls. For this six embodiment, the jaw 526 is pushed further closed for the second crimp than for the first crimp by causing the pin 534, which pushes jaw 526, to move in the slot 550 in the jaw 526, thus increasing the length between back pin 32 and the surfaces 550*a, b* in slot 550*a, b* against which pin 534 pushes, as shown in FIGS. 7A to 7D. It should be understood that it is essential to select precise angles between surfaces 550*a, b* and the line between the centers of pin 36 and pin 534 at completion of either crimp stroke. These angles can assure nearly equal hand force for each crimp stroke and proper surface to pin friction to assure proper holding and movement of the pin 534 as described herein.

The motion of the pin 534 may be partially controlled by a cam surface 580 that is part of each inside wall 514, 516 of the fixed body integrated with fixed jaw 12 and that has an apex section 580*a*, rear section 580*b* and front section 580*c* which are in contact with button extensions 534*a* (see FIG. 7B) of the pin 534 at different periods of the tool operation.

FIG. 7A shows the crimping tool at the beginning of a first crimping stroke, with handle 22 ready to be closed and pin 534 just crossing the apex of cam surface 580*a*. In FIG. 7A, the pin 534 abuts against the upper, front surface 550*a* of elongated holes 550 for completing a first crimping stroke, the pin being held in place by the friction which results from the closing force.

The pin 534 and its attached link 540 may also moved by a biasing member such as spring 570 that moves pin 534 back to position 550*b* in slot 550 for the second crimping stroke, position 550*b* being further from back pin 32 than is position 550*a*. The cam surface 580 may also be replaced by a biasing member such as a compression spring, like that described in the following seventh embodiment.

Figure 7C:
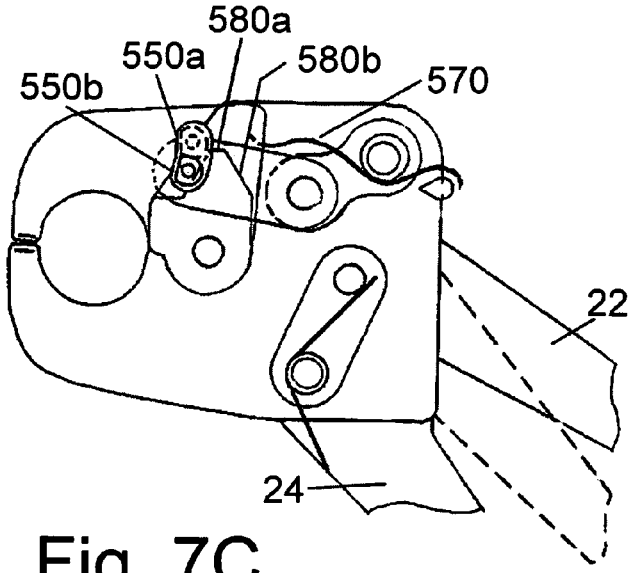
Figure 7B:
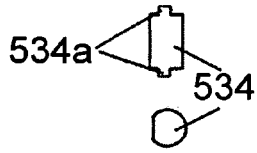

In FIG. 7C, the dotted line shows the end of the first crimping stroke started in FIG. 7A, followed by reopening of the movable handle 22 (assisted both manually and by released energy from the first crimping stroke) and downward motion of the pin 534 and the front link 540, rotating about pin 36, under the pressure by torsion spring 570. The latter spring may be anchored as shown to the tool body by bar 60. The pin 534 moves toward pivot pin 28 to contact the lower, front surface 550*b* of the elongated holes 550. The pin 534 then remains in the upper slot position 550*a* as the handles 22 and 24 and jaw 526 are closed. While spring 570 contacts link 540 and pushes down on both link 540 and pin 36 during the end of the first crimping stroke, pin 534 is held in position 550*a* by the resistance force of the uncrimped ring 4 and slot 550 in jaw 526. After the first crimp is completed and handle 22 opens to a comfortable hand gripping position, ring 4 resistance force drops, and spring 570 pushes pin 534 into slot position 550*b*. The second crimp is now completed by closing the handles 22, 24 and jaws 526, 12.

Figure 7D:
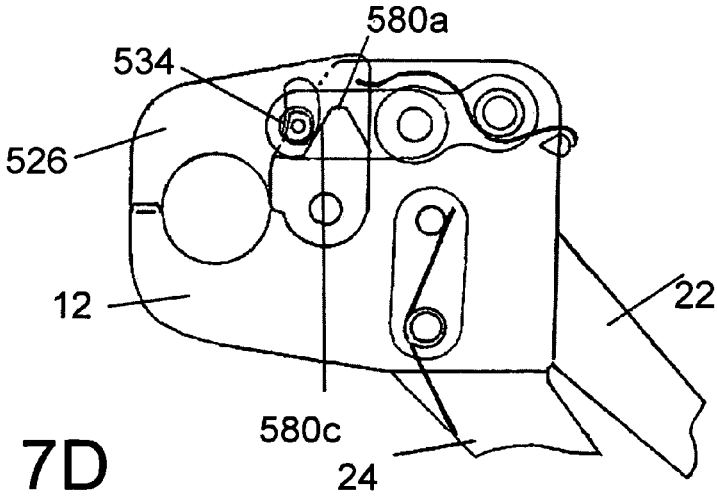

FIG. 7D illustrates the movable jaw 526 fully closed as the second crimping stroke has been completed with the movable handle 22 fully closed. Pin 534 rides up on cam 580 as handle 22 is opened and pulled back to fully open jaw 526 after completing the ring crimping by the second stroke and the cycle is repeated for the next ring.

Figure 8A:
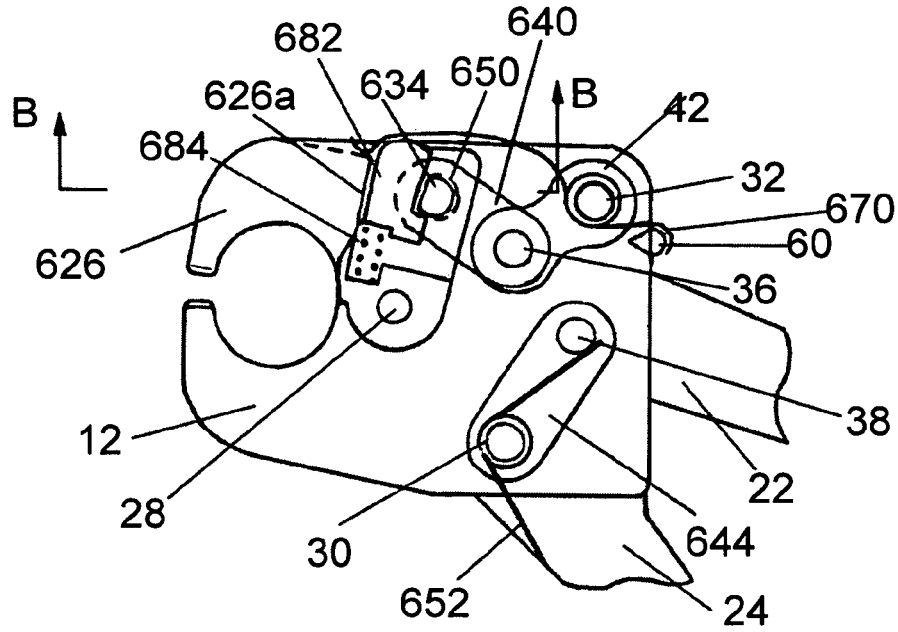
FIGS. 8A-8C are respectively a partial cut-away side view of a crimping tool, a partial cutaway top view of the same tool, and a second partial cut-away side view of the same crimping tool illustrating operations thereof according to embodiments of the present invention.
Figure 8B:
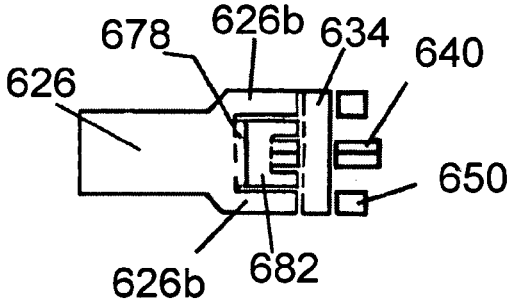
Figure 8C:
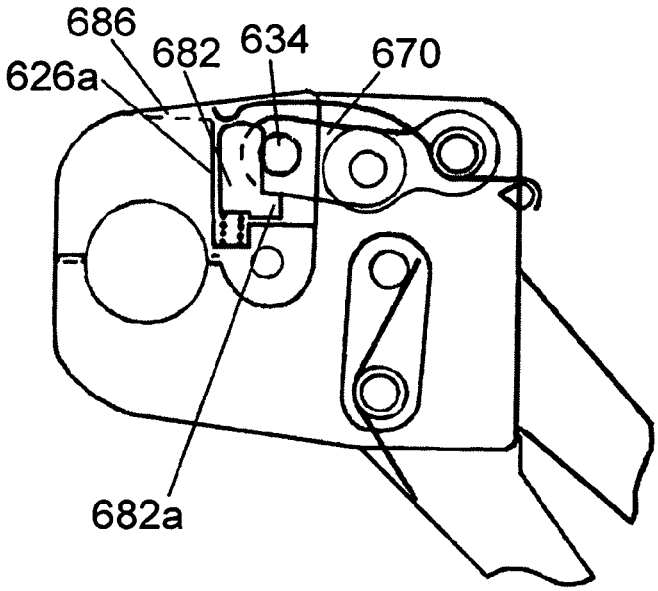

A seventh embodiment of the present invention is illustrated in FIGS. 8A-C that, instead of relocating a pin that pushes the moving jaw 626, introduces a "wedge" 682, to change the distance from the back pin 42 to the pushing point 626*a* on the moving jaw 626. The general crimping tool 10 is essentially the same as in the first embodiment described above (FIGS. 1A-B, FIGS. 2A-H) including first and second handles 22, 24, first jaw 12, side plates 14, 16, second link 42, pins 28, 30, 32, 36, 38, and a bar 60. A torsion spring 652 actively pushes on the pin 38 and keeps the tool jaws 12, 626 closed when no hand force is applied to the handles. When the wedge 682 position is pushed further from the pivot pin 28 by a biasing member 670, there is a shorter distance from back pin 32 to the moving jaw 626 surface 626*a*.

The front link 640 is fastened to the movable jaw 626 by a flat-sided pin 634. The flat-sided pin 634 is also located into the hole 650 in the outside wall 626*b* of the movable jaw 626.

FIG. 8A shows the crimp tool at the start of the first crimping stroke. FIG. 8B, a cross-section of FIG. 8A along line B-B, shows the flat-sided pin 634 that pushes against the wedge block 682 which moves up or down in the cavity 678 with a front wall 626*a* which receives the force of the upper linkage. The wedge block 682 is pushed upward by the compression spring 684 following the final crimping stoke and pulling back on the handle 22 to release the crimped ring. The wedge 682 stays up as shown in FIG. 8A during the first crimping stroke because crimp ring resistance on the jaw 626 counteracts the downward force of the flexure/torsion spring 670. A stopper 682*a* on the wedge block 682 prevents upward over-travel of the wedge 682.

The spring 670, which exerts a stronger force than compression spring 684 either abuts against a "V" groove 686 in the movable jaw 626 or pushes down the wedge block 682 as seen in FIG. 8C. Spring 670 may be located around pin 32, between back links 42, and anchored on bar 60. At the end of the first crimping stroke, resistance on the wedge from the partially crimped ring becomes negligible when the spring 670 engages the wedge 682 and pushes it down to the position seen in FIG. 8C for the second crimping stroke. When the wedge 682 is pushed down by biasing member 670, the jaw 626 is then fully closed to complete a second, tighter crimp. Upon reopening, the biasing member, like the compression spring 684, pushes the wedge 682 up when the handles 22 and 24 and the jaws 12 and 626 are fully opened, since the other biasing member 670 (here a flexure/torsion spring) does not push down on the wedge 682 during this motion.

A reversed wedge design may also be included as part of this embodiment. In this case, the face of the wedge that contacts the flat pin 634 is tapered in the opposite direction of wedge 682 and the compression spring 684 pushes the wedge up into position for the second crimp. The first crimp is preceded by locating the wedge into the position closest to pivot pin 28 using a biasing member, e.g., a spring like spring 670, that counteracts the push of the compression spring 684 such that the wedge remains in position as jaw 626 comes into contact with the ring to be crimped such that the ring resistance holds the reversed wedge in place. The spring 670 slips to the back of the wedge 682 over the links 540 during the second crimping stroke.

Figure 9A:
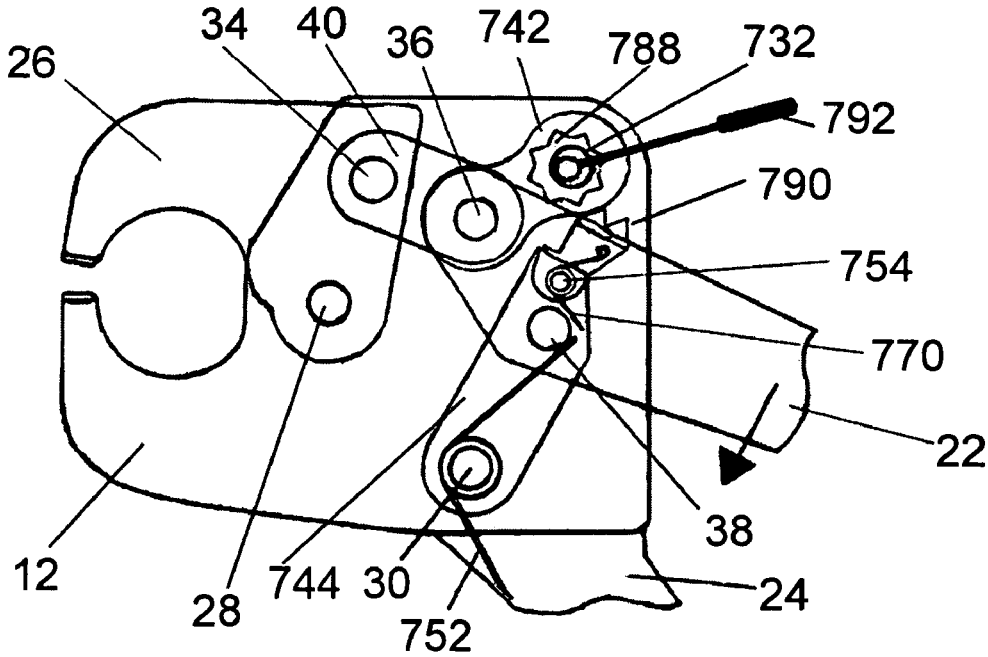
FIGS. 9A-9E are sequential, partial cut-away views of a crimping tool with one side plate removed and a detail view illustrating operations thereof according to embodiments of the present invention.
Figure 9B:
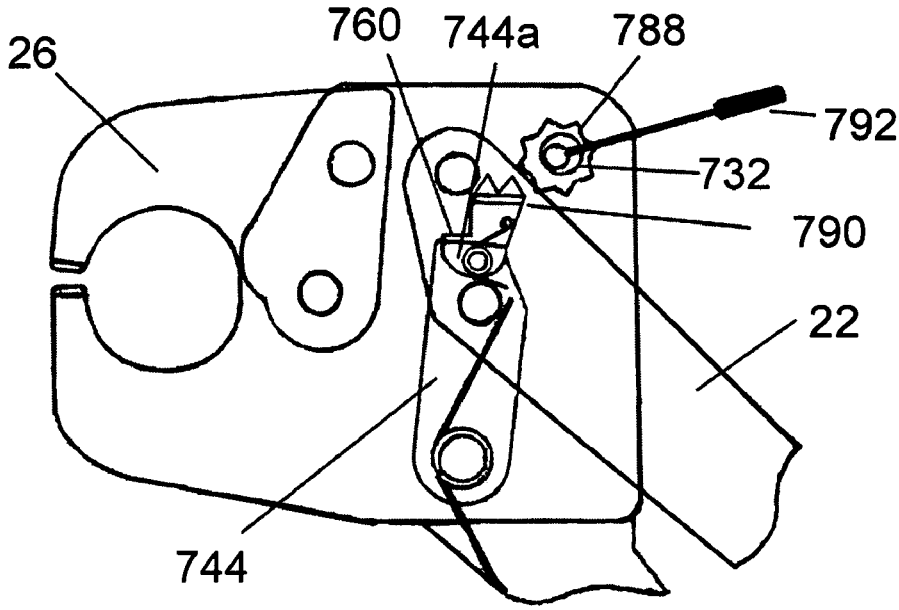

An eighth embodiment of the present invention is illustrated in FIGS. 9A-9D. The general crimping tool 10 is essentially the same as in the first embodiment described above (FIGS. 1A-B, FIGS. 2A-H) including first and second handles 22, 24, first and second jaws 12, 26, first and second handles 22, 24, side plates 14, 16, first and second links 40, 42, and pins 28, 30, 34, 36, 38. A torsion spring 752 actively pushes on the pin 38 and keeps the tool jaws 12, 26 closed when no hand force is applied to the handles. Two or more crimping strokes are provided for by incorporating a gear section 788, located between the two rear links 742, that is fastened onto eccentric back pin 732 and rotates in a counter-clockwise direction (as detailed in FIG. 9E). The gear section 788 is activated by a pivoted toothed segment or pawl 790, which is connected to the lower links 744 by a short pin 754. Controlling the one-way action of the pivoted toothed segment 790 is a small torsion spring 770 that performs a skipping and backing-up motion of the gear section as shown in FIG. 9B. Secondly, an abutment bar 760 bears against the upper corner 744*a* of the lower links 744 (FIGS. 9A and 9B). The gear segment 788 as seen in FIG. 9E is located eccentrically opposite of the eccentricity of the back pin eccentric center 732*a* in such a way to rotate concentrically with a manual lever 792 or automatic rotation of the back pin and is therefore able to engage the toothed segment 790 uniformly at each stroke. For each crimping stroke, the eccentric back pin 732 relocates the center of the back holes in back links 742 relative to the front of pin 34 pushing against the moving jaw 26.

To begin a crimping cycle after the final crimp of the previous ring, the gear 788 and eccentric pin 732 are manually rotated back to the initial crimp position in FIG. 9A, using for example the 792 external to the tool body. Or a lever mechanically activated by pulling fully back on handle 22 can engage and rotate the gear 788 and/or eccentric pin 732 to the initial position, although this is not shown. As the pawl 790 comes forward from full opening, the pawl 790 is flipped back rotating about pin 754 and passes under the gear 788, as seen in FIG. 9B, near completion of the first crimping stroke. The eccentric pin 732 stays in the same place, the handles 24 and 22 are fully closed, and the first crimp is completed (not shown).

Figure 9C:
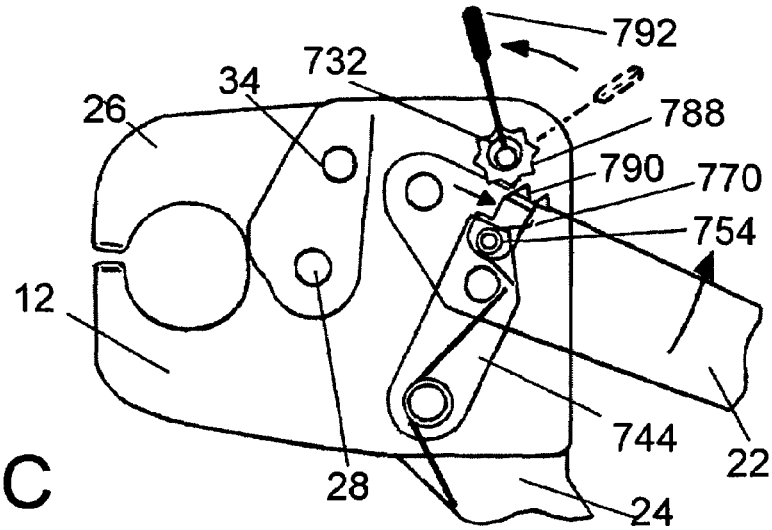
Figure 9D:
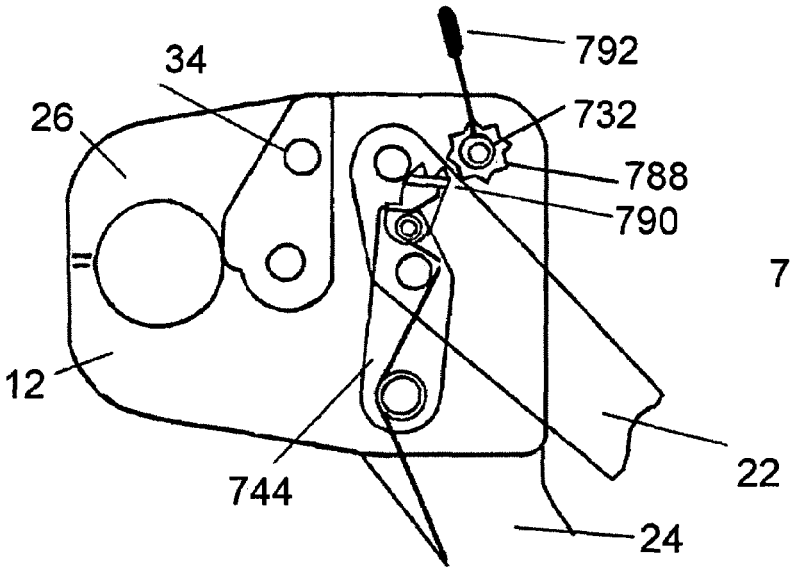
Figure 9E:
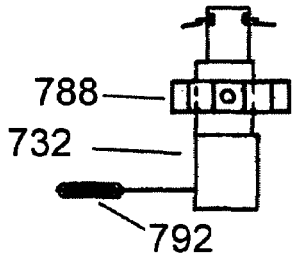

As shown in FIG. 9C, the handles 24 and 22 spring open after a crimp, the pawl 790 moves back with bottom link 264, engages the gear 788 and rotates the gear 788 in the counter-clockwise direction, since the pawl has a stop 744*a* to prevent its counter-clockwise rotation. This action positions the eccentric pin 732 in position for the next crimp. The handles 24 and 22 are then closed again, the pawl 790 moves forward again and is flipped back, and crimp is completed, as shown in FIG. 9D.

This approach allows for multiple crimping strokes because the diameter and eccentricity of pin 732 can be matched to the circumferential location and spacing of the gear 788 teeth such that each pawl 790 engagement and rotation of the gear 788 results in a movement of the center of pin 732 and back holes for links 742 so as to provide a satisfactory crimping progression with each stroke. A satisfactory progression may be defined as having a comfortable hand position and hand force required to be exerted for each crimping stroke until a final crimp to a predetermined ring diameter is accomplished.

Figure 10:
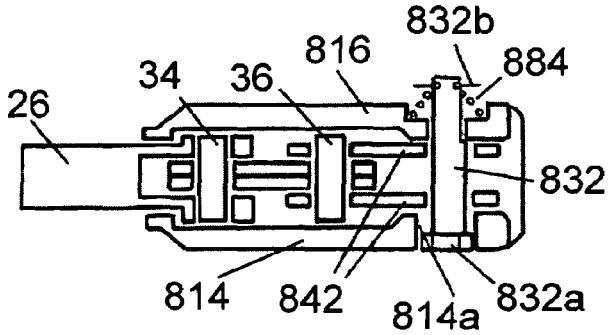
FIG. 10 is a partial cutaway top view representative of the tool of FIGS. 1A-1B illustrating an adjustment system according to embodiments of the present invention.

FIG. 10 illustrates an adjustment assembly for adjusting an eccentric back pin 832 for all embodiments from the first through the seventh embodiments, wherein the back pin 832 may have at one end 832*a* a holder for holding the rotational position of said back pin 832 about its axis, such as a hexagonal pin end 832*a* inside a hexagonal cavity 814*a* in the tool body wall 814. At the other end 832*b* of the pin 832, a biasing member 884 for controlling the axially translational position of the pin 832 may be located, such as the conical compression spring 884, held in place by holding member 832*b*, such as an e-shaped clip. Therefore, the biasing member end 832*b* of pin 832 can be manually pushed toward tool body wall 816, so that the hexagonal holding member 832*a* of pin 832 clears the cavity 814*a* and the pin 832 can then be rotated to a new position such that the hexagonal end 832*a* can be reinserted into cavity 814*a* at the new rotational position. Since pin 832 has eccentric sections passing through the holes in back links 842, then the position of such back links 842 relative to moving jaw 26 drive pin 34 can be readjusted without removing holding member 832*b* from the back pin 832. Accordingly, the back pin 832 can be adjusted in order to compensate for wear on the pins 34, 36 and 832 by moving forward the pivot point for the links 842 on the pin 832.

As discussed below, the present invention also includes designs based on a single overcenter tool rather than the double overcenter embodiments described above.

Figure 11A:
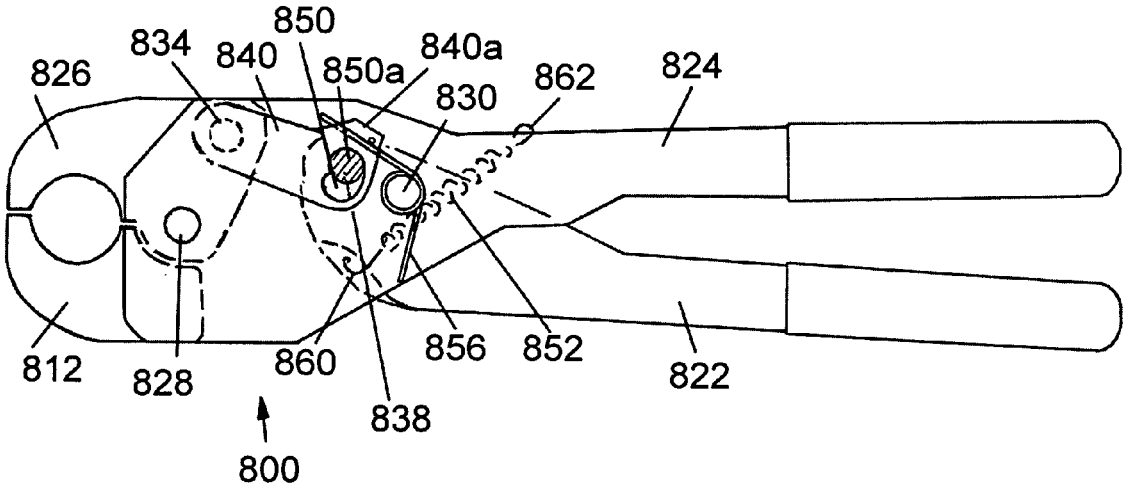
FIGS. 11A-11E are three sequential, partial cut-away views of a crimping tool with one side plate removed, a partial cutaway top view of the third side view, and a fourth side view, respectively, illustrating operations thereof according to embodiments of the present invention.
Figure 11B:
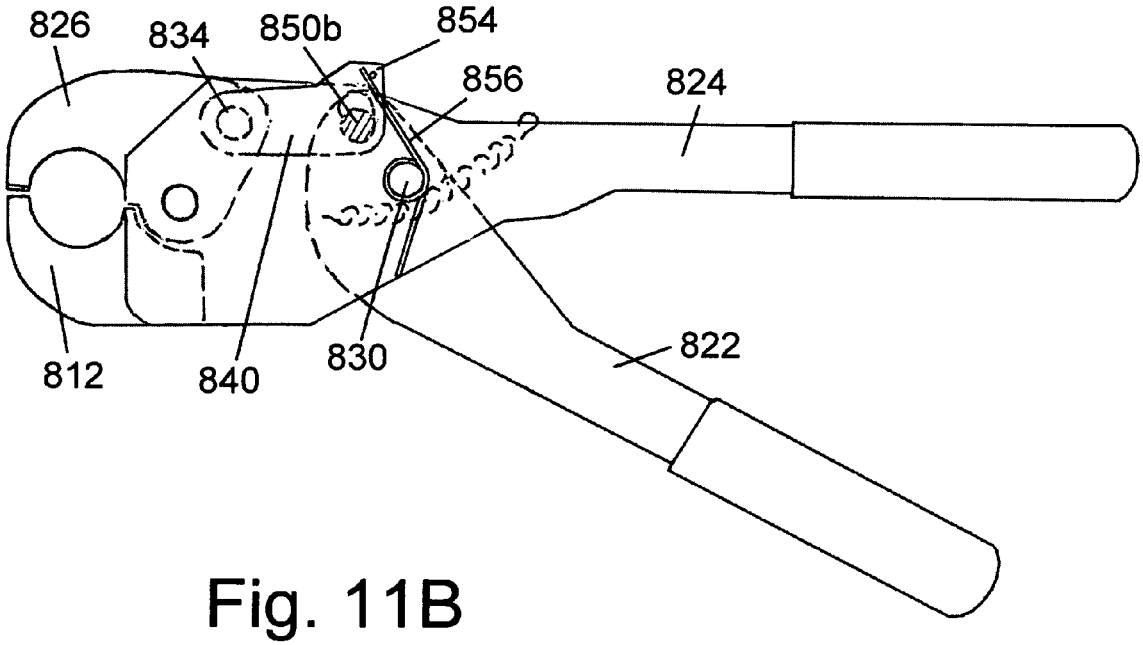
Figure 11C:
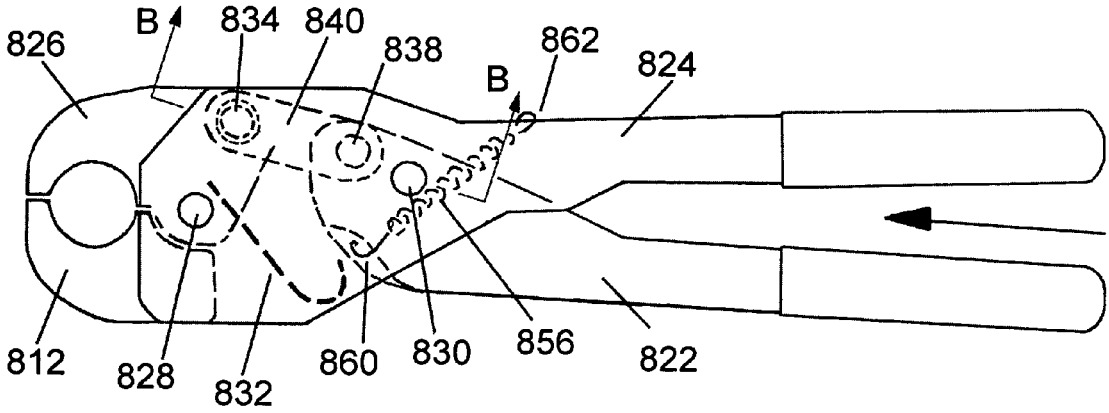
Figure 11D:
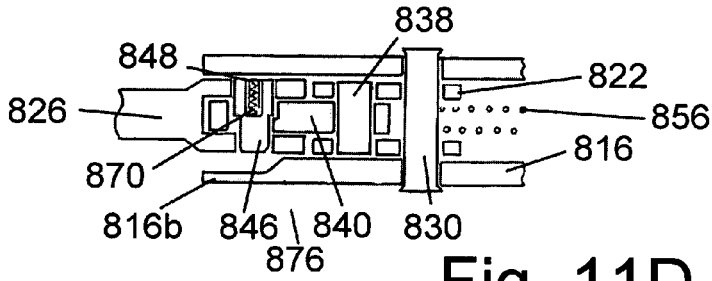
Figure 11E:
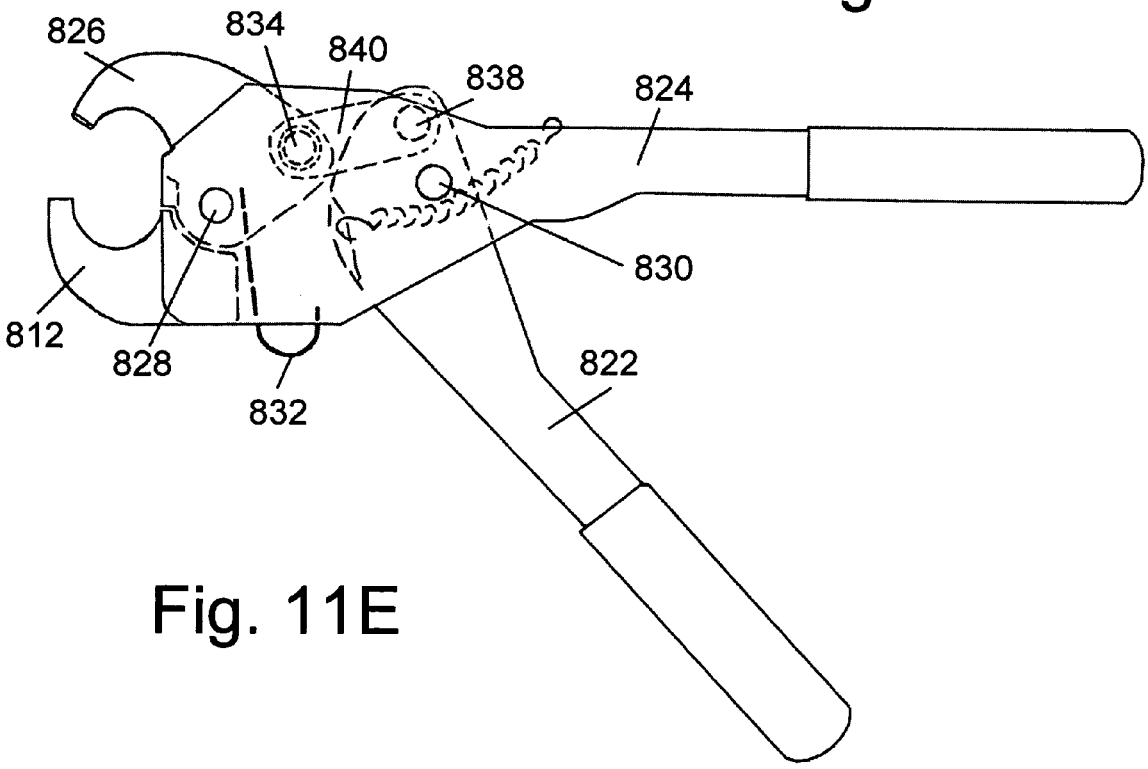

A ninth embodiment of the present invention is shown in FIGS. 11A-E. In FIGS. 11A-B, the embodiment duplicates the basic functions of the first embodiment for providing two stroke crimping described above, except with a single overcenter linkage assembly. In FIGS. 11C-E, the embodiment duplicates the basic functions of the fifth embodiment for providing two stroke crimping described above, except with a single overcenter linkage assembly.

For the ninth embodiment relative to the first embodiment, as shown in FIGS. 11A-B, two links are eliminated from tool 800 and the angle of the handles 822, 824 at full opening of the jaws 812, 826 is greater than for the previously described embodiments. The crimping tool 800 includes a main-body/fixed jaw 812 and a moving jaw 826 pivoting about pin 828. The side view of FIG. 11A shows that the movable handle 822 is rotatably connected to the combined fixed jaw 812 and fixed handle 824 at pin 830, and movable handle is rotatably connected by pin 838 to link 840, which is rotatably connected to moving jaw 826 at pin 834. The tension spring 852 attached to movable handle tab 860 and fixed handle tab 862 biases the handles 822, 824 toward closure when no hand force is applied. The link 840 also includes the slotted opening 850 that, together with the pin 38, provides a movable connection at first and second positions 850*a* and 850*b*. A biasing member, such as the illustrated torsion spring 856 that is connected about the pin 30, moves the end 840*a* of link 840 between the first and second positions 850*a*, 850*b*.

The pin 38 is pulled into position 850*a* when handles 822, 824 and jaws 812, 826 are fully opened to release a crimped ring and accept a new ring for crimping. The first crimping stroke is then completed as shown in FIG. 11A. After the first crimp, the handle 822 is opened in part by the released potential energy of the first crimp to a comfortable hand position as shown in FIG. 11B. The forces between pin 38 and link position 850*a* are released after the first crimp and spring 852 pushes link 840 at bar 854 so that pin 38 moves to position 850*b*. The second crimp is then completed by closing the handle 822 toward handle 824 moving the jaw 826 the second distance further than for the first crimp. The difference in jaw closure from the first to second is defined by the difference in the distance from the front of pin 830 to the back of pin 834 when pin 838 is in either position 850*a* or position 850*b*. The crimping cycle is repeated following the second crimping stroke. For the ninth embodiment relative to the fifth embodiment, as shown in FIGS. 11C-E, two links are eliminated and the angle of the handles 822, 824 at full opening of the jaws 812, 826 is greater than for the previously described embodiments. The crimping tool 800 includes a main-body/fixed jaw 812 and a moving jaw 826 pivoting about pin 828.

The side view of FIG. 11C shows that the movable handle 822 is rotatably connected to the combined fixed jaw 812 and fixed handle 824 at pin 830, and movable handle is rotatably connected by pin 838 to link 840, which is rotatably connected to moving jaw 826 at pin assembly 834. As seen in top view FIG. 11D, the axially translating pin assembly 834 includes a double-diameter, hollow pin 846 with an inside pin 848 and a compression spring 870. The moving jaw 826 is rotatably connected to the fixed jaw 812 at the pin 828. The tension spring 856 attached to movable handle tab 860 and fixed handle tab 862 biases the handles 822, 824 toward closure when no hand force is applied. The inclined surface section 876 provides the push for translation of pin assembly 834 as the handle 822 is pulled full open to release a crimped ring or accept a new ring. Trigger bar 832 allows easy release of jaw 826 which may be locked open when the handles 822, 824 and jaws 812, 826 are fully opened FIG. 11C illustrates the tool 800 near full closure for completion of either a first or second crimp. FIG. 11D shows the position of pin assembly 834 near completion of a first crimp. Pin 846's translation is affected by 1) the push of the compression spring 870 against pin 846's inside end wall and against inside pin 848 which pushes pin 846 toward the side wall 816's thin wall interior 816*b* when pin 846 pushes jaw 826 closed for the second crimp, and 2) the push against pin 846 by the internal inclined surface 876 when the jaw 826 is fully opened after the end of the second crimp, as shown in FIG. 11E. At the end of the second crimping stroke, with the movable jaw 826 pushed slightly more closed than for the first crimp condition seen in FIG. 11D, pin 846 moves away from the inclined surface 876 and is located along the thin wall 816*b*. The position of the pin 846 in relation to the offset holes in link 840 provides the increase in the distance rotated by moving jaw 826 from the first to second crimp. The relatively short distance between pins 838 and 830 provides a high mechanical advantage.

Figure 12A:
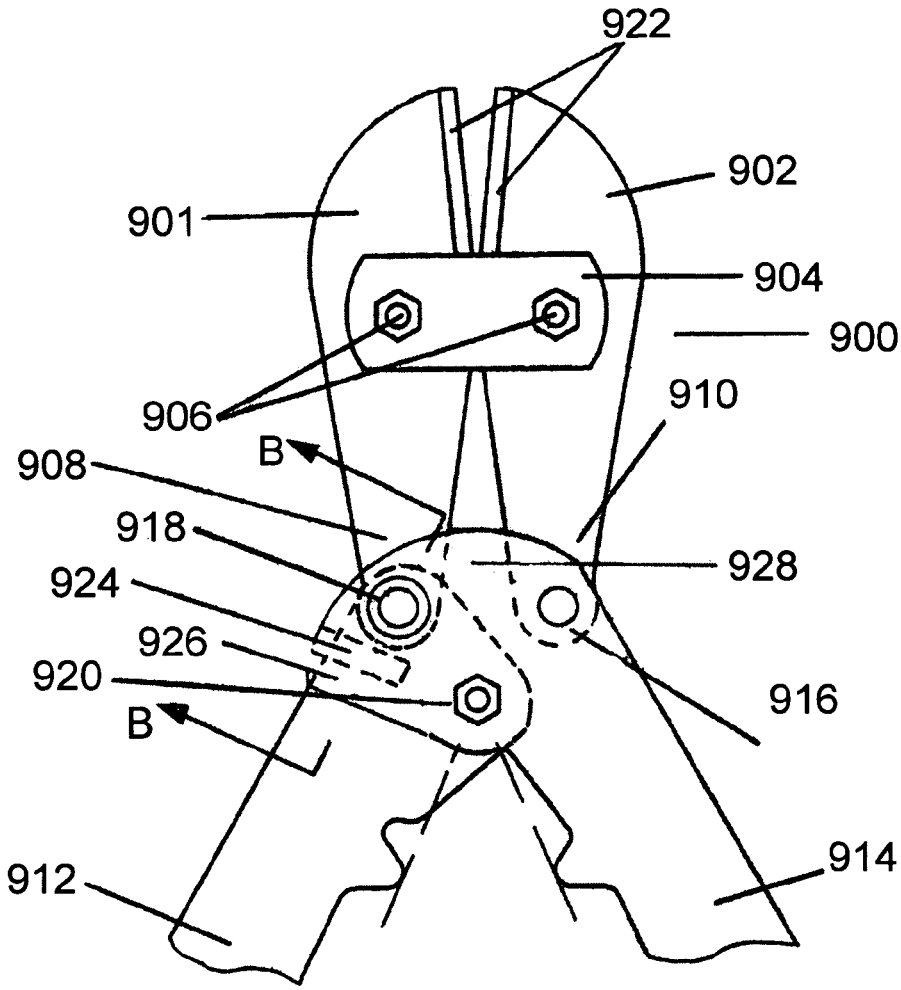
FIGS. 12A-12B are respectively a partial cut-away side view of a crimping/cutting tool and a partial cutaway top view of a crimping/cutting tool illustrating operations thereof according to embodiments of the present invention.
Figure 12B:
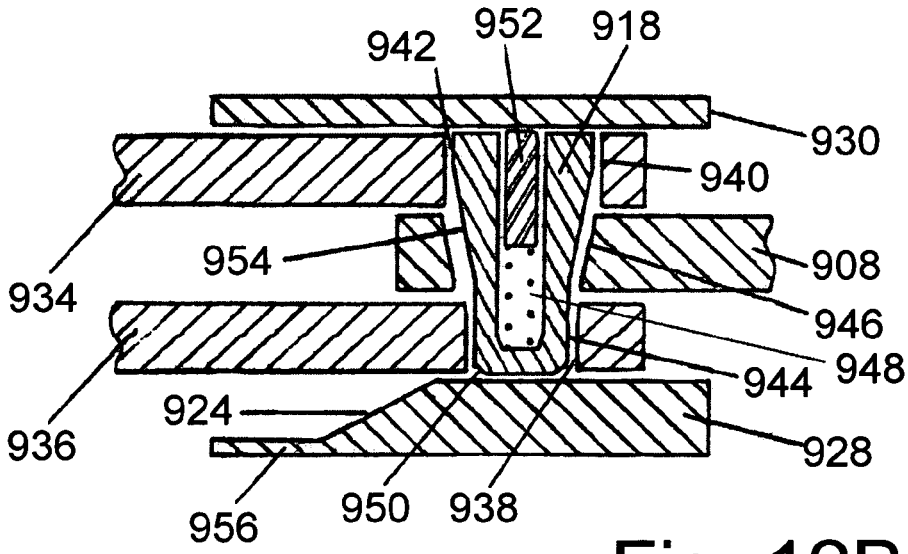

A tenth embodiment of the present invention is illustrated in FIGS. 12A-B. This embodiment is shown as a cutting tool 900 including movable jaws, with cutting ends 901-902 and pivoting ends 908 and 910, mechanically fastened by plates 904 and bolts 906. The ends of the movable jaws 908 and 910 are mechanically connected to the handles 912 and 914 by a connecting pin 916, a tapered pin 918, and a central pivot pin 920. As a cutting tool, the jaws each have sharp edges 922 and a multi-stroke assembly located between both outside walls 928 and 930 of the handle 914 and inner walls 934 and 936 of the handle 912. Said assembly consists of the tapered pin 918 with a tapered section 954 which engages into the tapered recess 946 of the blade 908. The tapered pin 918 has a large diameter 942 located into hole 940 of the inner wall 934, and a similar smaller diameter 944 is engaged into an equally smaller hole 938.

The tapered pin 918 is pressed against the thick wall 928 with a spring 948 pushing against small inside pin 952 bearing on wall 930. Closure motion of handles 912 and 914 allows pin 918, with each release and reopening of such handles, to move axially against inclined surface 924 with its edge 950 touching the thin wall 956 for complete closure of the cutting jaw.

The tenth embodiment is similar to the fifth embodiment except that the axially moving pin has a tapered change of diameter rather than a step from one diameter to the next. This is illustrated in FIG. 12B. The axial translation of pin 918 operates the same as for the fifth embodiment. An extended inclined surface section 924 and the tapered shape of pin 918 allow multiple (i.e., more than 2) crimping or cutting strokes if desired.

The tenth embodiment is shown here for application in a more conventional cutting tool, FIG. 12A, where full opening of the handles 912 and 914 and jaws 901 and 902 establishes position of pin 918 with the pin tip 950 onto the thicker wall 928. For cutting or crimping, a small jaw opening after the first stroke will set the pin 918 at a second axial position on the inclined surface of the inner body wall, which axial translation is stopped by the resistance of the object being cut or crimped. If repeated, proper inclined surface slope and length and tapered angle for the pin 918 will allow multiple strokes to complete cutting or crimping if desired.

Since both the tapered pin of the tenth embodiment and the wedge of the seventh embodiment act to allow progressive lengthening of the linkage system, these approaches therefore allow for multiple strokes for varying degrees of closure of the tool jaws.

Figure 13A:
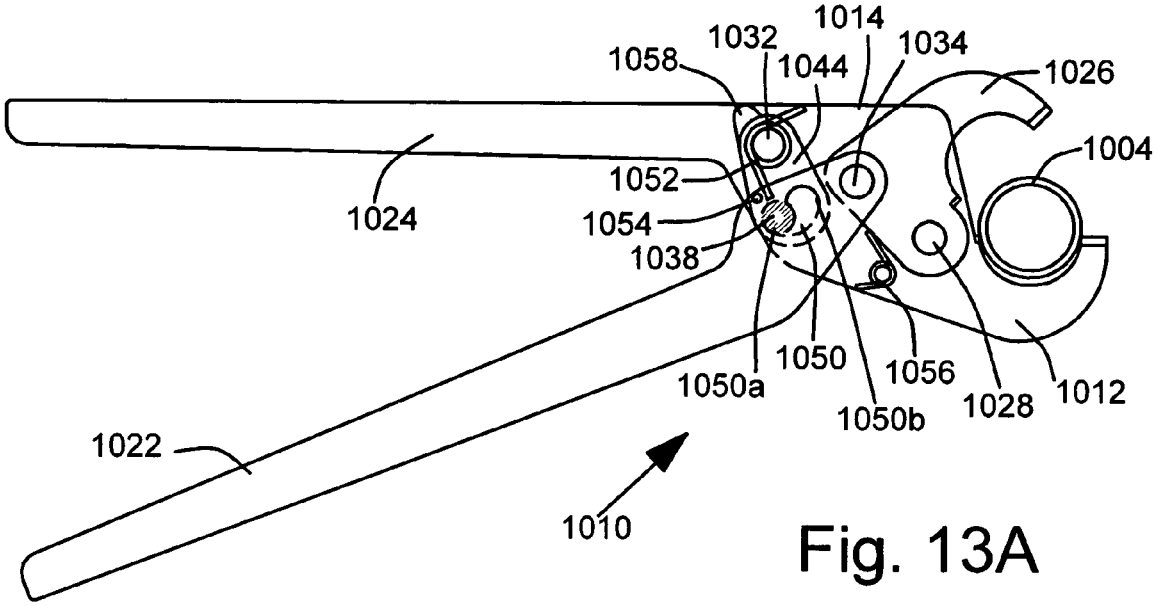
FIGS. 13A-13C are sequential, partial cut-away views of a crimping tool with one side plate removed illustrating operations thereof according to embodiments of the present invention.
Figure 13B:
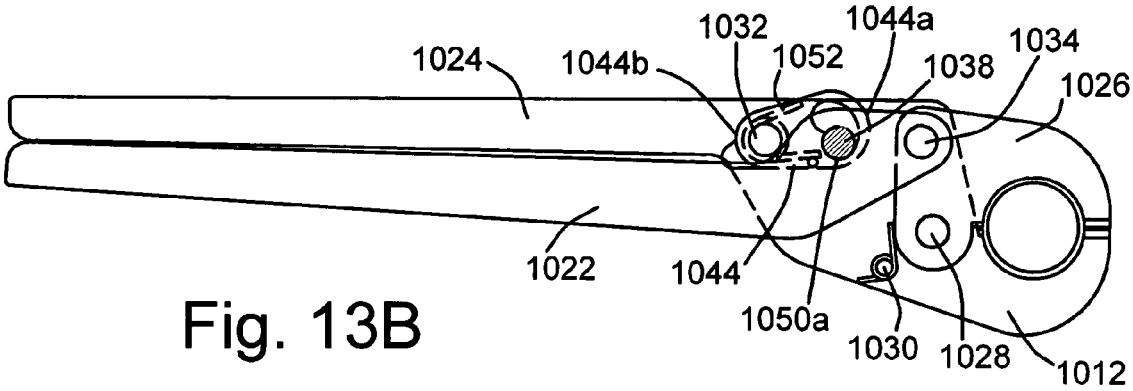
Figure 13C:
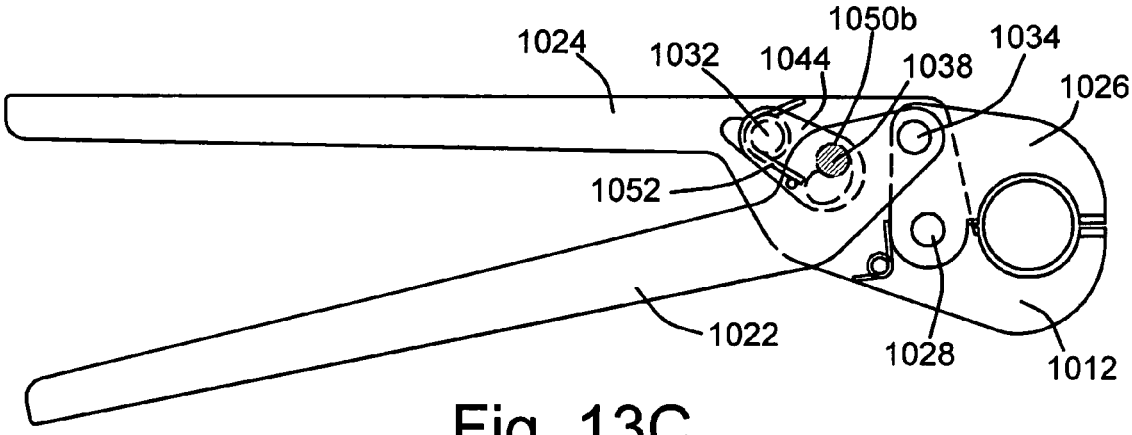

An eleventh embodiment of the present invention is illustrated in FIGS. 13A-C. Referring to FIG. 13A, the tool 1010 is opened fully to receive a ring 1004 for crimping or release a crimped ring. The tool 1010 contains an upper overcenter linkage mechanism, including a link 1044, the front end of a moving handle 1022, and pins 1032, 1034 and 1038. The overcenter linkage increases mechanical advantage exponentially as it extends toward aligning link and handle (overcenter position). The moving handle 1022 is attached to a moving jaw 1026 and the handle 1022 moves relative to a fixed handle 1024 which is rigidly attached to a fixed jaw 1012. Closing of the handles 22 and 24 imposes near alignment of the overcenter linkage mechanism, providing for closing of the jaws 1012, 1026 to complete crimping.

Both the opening and closing of the jaws 1012 and 1026 is accomplished by rotation and translation of the handle 1022 relative to handle 1024. The link 1044 extends between the fixed jaw 1012 and the handle 1022 to allow rotational and lateral movement of the handle 1022 with respect to the first jaw 1012 for opening and closing the second jaw 1026. Link 1044 attaches to handle 1022 by a slotted hole 1050 in the link having ends 1050*a* and 1050*b*. The link 1044 also rotates freely about pin 1032 at a second end 1044*b*.

The pins 1028 and 1032 extend through the side plates 1014 (shown) and 1016 (not shown) and are secured with snap rings, cotter pins, by swaging or through other suitable means as would be understood by one of ordinary skill in the art. The shorter, interior pins 1034 and 1038 are restricted from axial movement by the interior walls of side plates 1014 and 1016.

A torsion spring 1052, or other biasing member, is fixed in place about pin 1032 and provides a backward bias to link 1044. As illustrated, the spring 1052 may push against a rod 1054 which may be connected through link 1044. Also, a biasing member, such as the torsion spring 1056 held by a pin 1030, may be incorporated to bias the fixed jaw 1026 to rotate toward closure, thus assisting to close the handles 1022 and 1024 when no force is exerted on them.

The link end 1044*a* includes the slotted opening 1050 that, together with the pin 1038, provides a movable connection at first and second positions 1050*a*, 1050*b*. A biasing member, such as torsion spring 1052, moves the end 1044*a* between the first and second positions 1050*a*, 1050*b*.

The handle 1022 is configured to rotate in a first rotational direction about pin 1034 to drive the link 1044 through the pivotal pin 1038 pin to rotate the link 1044 in a second rotational direction, and to drive the jaw though the pivotal pin 1034 in the first rotational direction about the pin 1028 to close handles 1022 and 1024 and almost completely close the jaws 1012, 1026. The jaws 1012, 1026 are configured to close a first distance when the pin 1038 is in the first position 1050*a* and a second distance when the pin 1038 is in the second position 1050*b* of the link end 44*b*. The torsion spring 1052 is configured to urge the link end 1044*a* so that the pin 1038 is held in the holes in link 1044 as it moves between the first position 1050*a* and the second position 1050*b*. These two positions in slot 1050 provide the means for a two-stoke crimping tool in which the crimping is completed in two successive closures of the handles 1022, 1024 using much less hand force than if crimping with a single hand stroke. Although the tool 1010 has been described as allowing two crimping strokes based on the two positions of the slot 1050 in link end 1044*a*, it should be understood that additional link positions may be used to provide three or more crimping strokes under some dimensional variations of pin 1038 and slot 1050.

As shown in FIG. 13A, the jaws 1012, 1026 of crimping tool 1010 are in a fully open position, and the link end 1044*a* is in the first position 1050*a*. This fully open position is that required, for example, for releasing a crimped ring or accepting a new ring 1004 for crimping. Since handle 1022 has been pulled fully back laterally as shown in FIG. 13A, the pin 1038 is urged to pull back into the first position 1050*a* of link end 1044*a*. A stop 1058 on link 1044 is included to impact the fixed handle 1024 or fixed jaw 1012 assure that link 1044 cannot over-rotate when the handle 1022 is opened and fully pulled back, ensuring that pin 1038 remains in the first position 1050*a* thus setting the proper condition for beginning a first crimping stroke. Another abutment (usually the moving jaw 26 touching the links 1044) keeps the jaws 1012, 1026 and therefore the handles 1022, 1024 from moving further. When the handles 1022, 1024 and jaws 1012, 1026 are fully opened to accept a ring, the handles 1022, 2104 and jaws 1012, 1026 can be held in this receiving or releasing position by a single hand grip pressing the handles toward each other.

After fully opening to enclose a new ring 1004, the handle 1022 is moved slightly open and toward the jaws 1102, 1026 to partly close the jaws 12, 26. The handle 1022 is further closed and the link 1044 moves in the second rotational direction, and the torsion spring 1052 passes through its relaxed or neutral position and begins to push bar 1054 to urge the link 44 in the first opposite rotational direction. However, at this point jaws 1012 and 1026 are already beginning to exert pressure on the ring 1004 to be crimped and pin 1038 is held in position 1050*a* by the resultant forces transmitted through the pins and links by the resistance to crimping by the ring 1004. The handle 1022 and the second jaw 1026 further move in the first rotational until the condition of FIG. 13B is reached, illustrating completion of a first crimping stroke in which the handle pin 1038 remains in the first position 1050*a* and link end 1044*a* ends in the position shown in FIG. 13B, allowing the jaws 1102, 1026 to close a first distance for crimping.

A second crimping cycle motion completes the crimping of the ring 1004 which is partially crimped to the degree shown in FIG. 13B. The second crimping cycle immediately follows that shown in FIGS. 13A-B and during said second cycle the handle pin 1038 is in the second position 1050*b* of link end 1044*b*, as shown in FIG. 13C. The potential energy from strain stored in the ring/pipe/fitting, links, pins, side plates, handles, and jaws during the first compression of the crimp ring 1004 is released, causing the handles to spring quickly open, aided by the biasing member 1052. A "snap" or "click" sound from the link 1044 jumping to position 1050*b* on pin 1038 indicates completing of the first crimp and suitability for beginning handle closure to complete the second crimp.

The jaws 1012, 1026 stay closed on the ring and typically move apart less than 15% of a ring 1004 wall thickness. This jaws position and the increased bias, for example by torsion spring 1056 on jaw 1026, allows pin 1038 easy motion in slot 1050. The torsion spring 1052 urges the link end 1044*a* back (for example, by pushing on bar 1054) such that pin 1038 jumps into the second position 1050*b* from the first position 1050*a* as the first handle 1022 separates from the second handle 1024. The relative geometries of springs 52, 56, link 1044 and slot 1050 are such that the opening of the handles 1022, 1024 is to a comfortable hand position for making the second crimp. The jaws 1012, 1026 maintain snug contact with the ring 1004 throughout the second crimping sequence such that the second crimp will take place on the ring 1004 in essentially the same position as the first crimp.

FIG. 13C illustrates the completion of the second crimping stroke and the crimping cycle of the eleventh embodiment. Jaws 1102, 1026 and handles 22, 24 are closed to the full extent required for designated crimping of the ring 1004. The position of pin 1038 and slot location 1050*b* relative to pin 1028 after the second crimping stroke is almost the same as position of pin 1038 and slot location 1050*a* relative to pin 1028 after the first crimping stroke. Therefore, the degree of alignment of pins 32, 34, 38 may be the same at the end of both crimping strokes, allowing a maximum mechanical advantage to be exerted in both cases. This is because the pin 1038 is held fixed relative to handle 1022 and handle 1022 is closed to the same position at the end of each crimping stroke (i.e., the rear, free tip of handle 1022 almost touches the rear, free tip of handle 1024).

Crimping tools described herein may be used with any type of tubing, such as cross-linked polyethylene (PEX) or polybutylene (PB) tubing; however, the tool may be particularly useful when working with water supply plastic tubing having a relatively high resistance, such as cross-linked polyethylene (PEX). The crimping tools described herein may be used with any size tubing, such as '⅜ inch', '½ inch,' and '¾ inch' tubing. There are generally three common sizes of crimp rings—'⅜ inch', '½ inch,' and '¾ inch', in addition to a less common '1 inch' ring. Additional sizes may be accommodated. Separate tools can be used for different size crimp rings, each tool having jaws sized for a particular ring dimension. Alternatively, a single tool can be configured to accommodate various sizes of crimp rings through the use of interchangeable jaws, or through the use of an insertable die to modify the jaw opening, for example, to reduce a ¾" jaw opening to a ½" jaw opening, as would be understood by one skilled in the art.

The motion of the handles of the crimping tool of the present invention relative to each other may be compact, which can allow a relatively wide opening of the jaws for crimping when moving the moving handle in a lateral or near lateral motion along an axis X in the direction of the length of the tool (FIG. 2A). The tool of the present invention may be sized and configured so that the handles do not need to open more than the distance typically encompassed by the grasp of a hand. The mechanisms of the tool can be designed such that most of the motion of compressing together the handles of the tool of the present invention results in the final small closure of the jaws on the ring. A high mechanical advantage (for example, 20 times or more) can be realized. The mechanical advantage can increase nearly in proportion to the resistance force of a ring to be crimped as the final crimped diameter of the ring is approached. The mechanisms and geometry of tool components may be designed such that the force required for completing the second crimp or cut is nearly the same as the force for completing the first crimp or cut in a two-stroke tool. For example, each stroke of the two-stroke tool may be about 55%-60% of the force required for crimping or cutting with a single stroke tool.

Crimping tools according to embodiments of the present invention may be sized and configured such that two strokes may be used based on specific dimensions and compression resistance of the rings to be crimped. Both crimping motions of the tool may be performed with one hand. Although the tool of the present invention is described as allowing two crimping, it should be understood small modifications obvious to those practiced in the art may be implemented to provide three or more crimping strokes.

The two-stroke operation of the tool of this invention may be "automatic" such that the tool handles and mechanisms for establishing mechanical advantage are automatically repositioned after the first crimp so as to be in position for the second crimp. Specifically, the release of potential energy from the first crimp can cause the handles to spring open to a comfortable hand grip position. Simultaneously, a biasing member may be released by the reduced pressure on the ring and affected tool mechanisms so as to position such mechanisms for establishing mechanical advantage. Thus, any separate manual mechanism for transitioning from the first to the second crimp stroke may be unnecessary. The ring to be crimped does not have to be released between the first and second crimp. No additional scarring of the ring may be caused by the second crimp, and, therefore, the roundness specifications for the crimp may be preserved.

The full opening of the handles and jaws of the tool to completely release a crimped ring and to encircle a new uncrimped ring also provides the motions of the tool mechanisms necessary to reset the jaws and handles to the positions necessary for beginning a new first stroke crimp.

The linking assemblies according to the present invention can be implemented in the tool design shown in U.S. Pat. No. 5,267,464 to Cleland relatively easily and economically without making changes to the body or jaws. Such modifications can be made using changes in stamping procedure or spring geometry.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A crimping tool comprising:

a first, fixed, jaw member;

a second, moving, jaw member pivotally connected to the first jaw member at a first pivot location;

a first link having first and second ends connected at the first end to the second jaw member at a second pivot location defined by a pivot member;

a second link pivotally connected to the first link second end at a third pivot location and pivotally connected to the first fixed jaw member at a fourth fixed pivot location;

a first, moving, handle attached to the third pivot location;

a second fixed handle rigidly connected to the first fixed jaw;

a third link connected at a first end thereof to the first handle at a fifth pivot location defined by a pivot member and pivotally connected at an opposite second end thereof to the first jaw member at a sixth fixed pivot location;

wherein at least one of the first link first end and the third link first end are movable between first and second positions relative to the pivot member at the second pivot location and the pivot member at the fifth pivot location, respectively; and wherein, closing the first handle toward the second handle drives the first and second links through the third pivot location to rotate the second jaw member about the first pivot location in a first rotational direction, to rotate the first link in the same first rotational direction, to rotate the second link in a second, opposite, rotational direction, and to rotate the third link in the first rotational direction about the sixth pivot location, to close the first and second jaw members a first distance when at least one of the first link first end and the third link first end are in the first position and to further close the first and second jaw members a second distance when at least one of the first link first end and the third link first end are in the second position.

2. The crimping tool of claim 1, further comprising a first biasing member configured to urge the third link first end from the first position to the second position.

3. The tool of claim 2, wherein the first biasing member is configured to urge the third link first end from the first position to the second position when a driving force on the handle is released, such that the relative position of the first and second jaws remains essentially at the first closed distance.

4. The tool of claim 1, wherein the third link first end comprises an aperture which defines the first and second positions of the third link first end relative to the fifth pivot location.

5. The tool of claim 1, wherein movement of the third link first end from the first position to the second position, relative to the pivot member at the fifth pivot location, produces an audible sound, and the pivot member at the fifth pivot location comprises a pivot pin.

6. The tool of claim 1, wherein the second end of the third link abuts the first jaw member or the second, fixed, handle when the first and second handles and the first and second jaws are fully opened, such that the third link first end is set at the first position.

7. The tool of claim 4, wherein the aperture is configured such that the pivot member at the fifth pivot location comprises a pivot pin that is through the aperture and remains at the first position of the third link first end when the first and second jaws are closed a first distance.

8. The tools of claim 1, further comprising a second biasing member to urge the second link in said second opposite rotational direction to assist closing together of the first and second handles and to assist movement of the third link first end between the first and second positions.

9. The tool of claim 1, wherein the first, moving, handle moves laterally away from the first pivot location during opening of the jaws to their maximum spread, thus providing an approach to minimizing the distance between the ends of the fully opened handles.

10. The tool of claim 1, wherein the fourth fixed pivot location comprises a pivot pin that is eccentric and has a head at one end for fixing its rotational position and a biasing member at the other end fixing its axial position, such that the pin can be pushed against the biasing member to release the head for rotating the pin to the desired eccentricity.

11. The tool of claim 1, wherein the fifth pivot location comprises an aperture in the first moving handle such that the aperture in the handle defines the first and second positions of the third link first end.

12. The tool of claim 11, wherein the first biasing member also biases the third link in the first rotational direction and toward the first position of the third link first end when the first and second handles are fully opened.

13. The tool of claim 1, wherein the pivot member at the fifth pivot location comprises a pivot pin, and the third link first end includes an elongated aperture with the pivot pin at the fifth pivot location positioned through the aperture, the elongated aperture having a first end distal to the sixth pivot location and a second end proximal to the sixth pivot location, which second aperture end defines the first position relative to the pivot pin at the fifth pivot location;

a fourth link having first and second ends, also between the fifth and sixth pivot locations and adjacent to the third link, which fourth link may be disengaged or engaged at the fourth link first end to move the fifth pivot pin, which is through the third link aperture and held in the moving handle, from the first to the second position in the third link first end aperture.

14. The tool of claim 13, wherein the fourth link is a cam member adjacent to the third link comprises a surface at a first end thereof proximate the third link first end and pivotally connected at a second end to the sixth pivot location;

wherein the cam member first end surface is configured to engage the fifth pivot pin and to urge the pivot pin to the third link aperture first end to define the second position relative to the fifth pivot location; and wherein the cam member is configured to disengage the fifth pivot pin such that the pivot pin is urged by the first handle to the third link second aperture end to define the first position relative to the fifth pivot pin at the firth pivot location.

15. The tool of claim 14, further comprising a biasing member which urges the cam member to engage the fifth pivot pin and move it from the first position to the second position in the third link first end aperture, such engagement producing an audible sound.

16. The tool of claim 13, wherein the fourth link first end rotates about the pivot pin at the fifth pivot location in the third link first end aperture and wherein a notch in the fourth link second end engages the sixth pivot location to move the fifth pivot pin to the second aperture position.

17. The tool of claim 16, comprising a first biasing member to urge the fourth link to engage the sixth pivot pin and a second biasing member to urge the handles toward closure when no other force is exerted on the handles.

18. The tool of claim 1, further comprising:

a first biasing member which urges the third link in the first rotational direction to urge closing together of the first and second jaws and handles when no other force is exerted on the handles;

wherein the first handle is configured to drive the first and second links through only the third pivot location to rotate the second jaw member about the first pivot location in a first rotational direction, and to rotate the first link in the same first rotational direction about both the second pivot location and the third pivot location, and to rotate the second link in a second, opposite, direction about both the third pivot location and the fourth pivot location, and to rotate the third link in the first rotational direction about the sixth pivot location;

and wherein a surface of a second pivot location pin in the first link contacts the second moving jaw at a first distance from the fourth pivot location to close said second jaw a first distance and subsequently the second pivot location pin in the first link contacts the second moving jaw at a second distance from the fourth pivot location to close said second jaw a second distance.

19. The tool of claim 18, wherein the second pivot location pin includes a smaller and a larger diameter axially contiguous, the smaller diameter representing a first closure distance of the first jaw, and the larger diameter representing a second closure distance of the first jaw caused by different contact points between the second jaw and the second pivot location pin.

20. The tool of claim 19, wherein an inclined surface in the first fixed jaw and a biasing member moving with the second pivot location pin are configured to cooperatively urge the second pivot location pin axially between the first and second diameters in the first link such that the second pivot ends contacting the moving jaw move to produce the first and second jaw closures.

21. The tool of claim 20, wherein the movement of the biasing member over the inclined surface when the handles are fully opened sets the axially moving pin for the first distance position between the pin contact surface and the fourth pivot location.

22. The tool of claim 21, wherein translation of the second location pivot pin to its larger diameter position in the first link produces an audible sound.

23. The tool of claim 18, wherein the second pivot pin through the first link moves in an aperture in the first moving jaw with the aperture having a first end representing the position for the first distance of a second pivot location pin contact surface from the fourth pivot location, and a second end representing the position for the second distance of the second pivot location pin contact surface from the fourth pivot location.

24. The tool of claim 23, comprising a second biasing member to urge the second pivot end of the first link between the first aperture position and the second aperture position.

25. The tool of claim 18, wherein the distance of the second pivot location pin contact surface with the second jaw from the fourth pivot pin is changed by contact of the second pivot location pin with a wedge-shaped member that that moves inside the second jaw in a direction normal to the first link axis.

26. The tool of claim 25, comprising a first biasing member to urge the wedge member away from the first contact location between the wedge and the second pivot pin and a second biasing member to urge the wedge toward the first contact location.

27. The tool of claim 18, wherein the fourth pivot location has a pin with an eccentric diameter which is rotated to change the distance between the surface contacting the second pivot pin with the second moving jaw and the surface contacting the fourth pivot pin with the first fixed jaw to allow two or more closure distances of the first and second jaws corresponding to each eccentric pin position.

28. The tool of claim 27, comprising a circular gear section fixed about the diameter of the fourth pivot eccentric pin, which gear section engages a pawl member following closure of the first and second handles to rotate the eccentric pin to a position for the next closure distance of the second jaw.

29. The tool of claim 28, comprising a biasing member which urges the pawl in the first rotation direction and a lever for resetting the eccentric pin before beginning the first closure distance of the second jaw.

* * * * *

UNITED STATES PATENT AND TRADEMARK OFFICE

CERTIFICATE OF CORRECTION

PATENT NO. : 7,503,201 B2
APPLICATION NO. : 11/386643
DATED : March 17, 2009
INVENTOR(S) : Cleland et al.

It is certified that error appears in the above-identified patent and that said Letters Patent is hereby corrected as shown below:

In the Claims:

Column 25, Claim 14, Line 21: After "relative to the" please delete "fifth"

Column 26, Claim 19, Line 1:
Please correct "the smaller diameter representing a first closure"
to read -- a smaller diameter representing the first closure --

Signed and Sealed this

Nineteenth Day of May, 2009

JOHN DOLL
*Acting Director of the United States Patent and Trademark Office*